US010702724B2

(12) United States Patent
Subzda

(10) Patent No.: US 10,702,724 B2
(45) Date of Patent: Jul. 7, 2020

(54) SAFETY FENCE SUPPORT AND ANCHORING SYSTEM

(71) Applicant: Frank Subzda, Fort Myers, FL (US)

(72) Inventor: Frank Subzda, Fort Myers, FL (US)

( * ) Notice: Subject to any disclaimer, the term of this patent is extended or adjusted under 35 U.S.C. 154(b) by 0 days.

(21) Appl. No.: 15/848,478

(22) Filed: Dec. 20, 2017

(65) Prior Publication Data

US 2018/0127991 A1 May 10, 2018

Related U.S. Application Data

(63) Continuation of application No. 14/943,351, filed on Nov. 17, 2015, now abandoned.

(51) Int. Cl.

| | |
|---|---|
| ***E04G 5/14*** | (2006.01) |
| ***A62B 35/00*** | (2006.01) |
| ***E04G 21/32*** | (2006.01) |

(52) U.S. Cl.

CPC ..... *A62B 35/0068* (2013.01); *E04G 21/3223* (2013.01); *E04G 21/3276* (2013.01)

(58) Field of Classification Search

CPC ..... E04G 5/14; E04G 5/001; E04G 5/145; E04G 21/3276; E04G 21/3223

See application file for complete search history.

(56) References Cited

U.S. PATENT DOCUMENTS

| | | | | |
|---|---|---|---|---|
| 5,121,579 | A * | 6/1992 | Hamar | A63B 71/028 248/538 |
| 5,121,891 | A * | 6/1992 | Goldsmith | A47B 13/023 248/188.8 |
| 6,015,139 | A * | 1/2000 | Weber | E04F 11/1812 256/65.14 |
| 7,530,551 | B2 * | 5/2009 | Kuenzel | E04G 21/3233 182/113 |
| 9,347,196 | B2 * | 5/2016 | Wagler | E02D 27/42 |
| D826,702 | S * | 8/2018 | Barnes | D8/382 |
| 2003/0221385 | A1 * | 12/2003 | Platt | E04F 11/1812 52/296 |
| 2009/0120718 | A1 * | 5/2009 | O'Gorman | E04G 21/3223 182/113 |

* cited by examiner

*Primary Examiner* — Alvin C Chin-Shue
(74) *Attorney, Agent, or Firm* — William E. Noonan

(57) ABSTRACT

A safety fence support and anchoring system is used in a building that includes an elevated deck supported above an underlying deck. The system includes a base plate secured to the upper surface of the elevated deck and a stanchion receptacle attached to an extending upwardly from the base plate for receiving and holding a stanchion of the safety fence such that the stanchion extends upwardly from the elevated deck. A deck penetrating anchor component is connected to and suspended below the base plate and configured for being received by and constrained within an opening formed through the elevated deck, which opening extends fully through the elevated deck from the upper surface to the lower surface thereof. The deck penetrating anchor component is exposed and made accessible through the lower surface of the elevated deck.

9 Claims, 17 Drawing Sheets

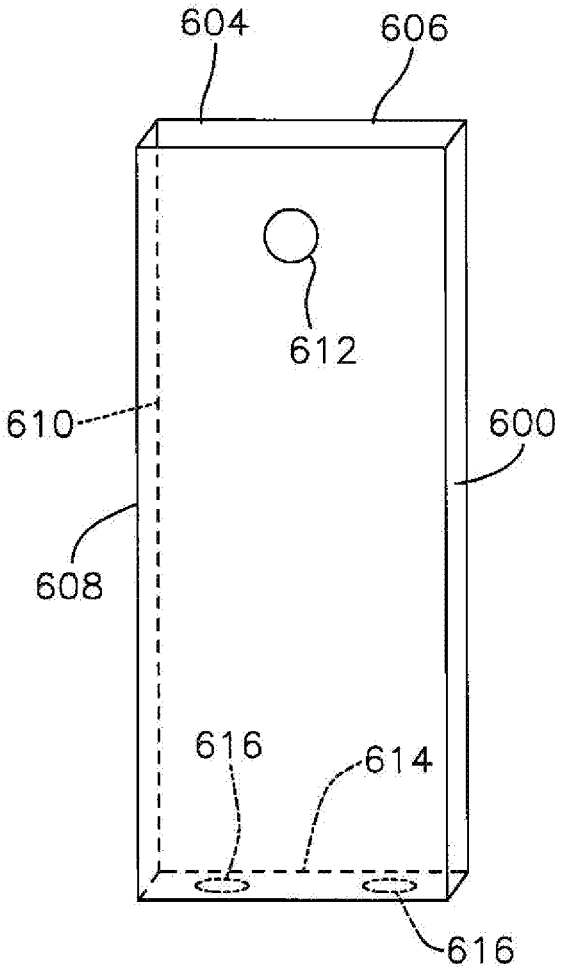
*Fig.* 18
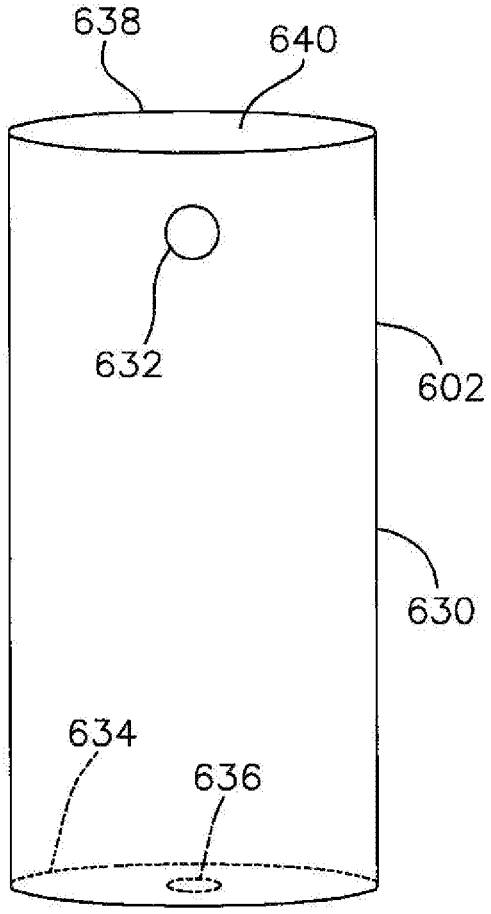
*Fig.* 19

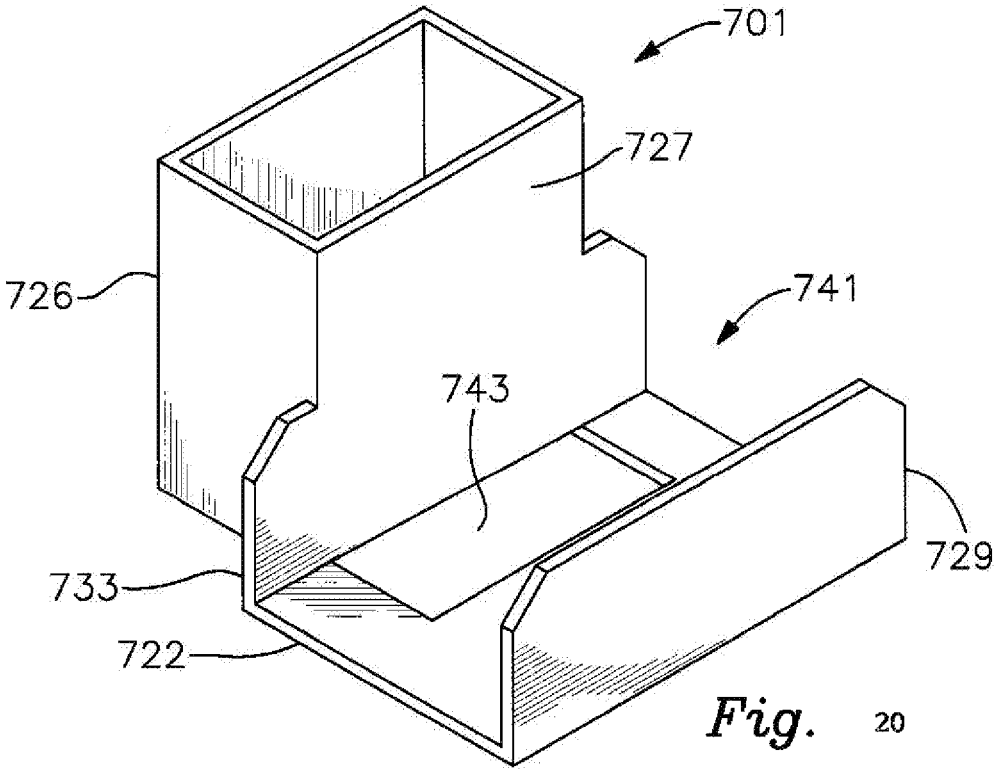
*Fig.* 20
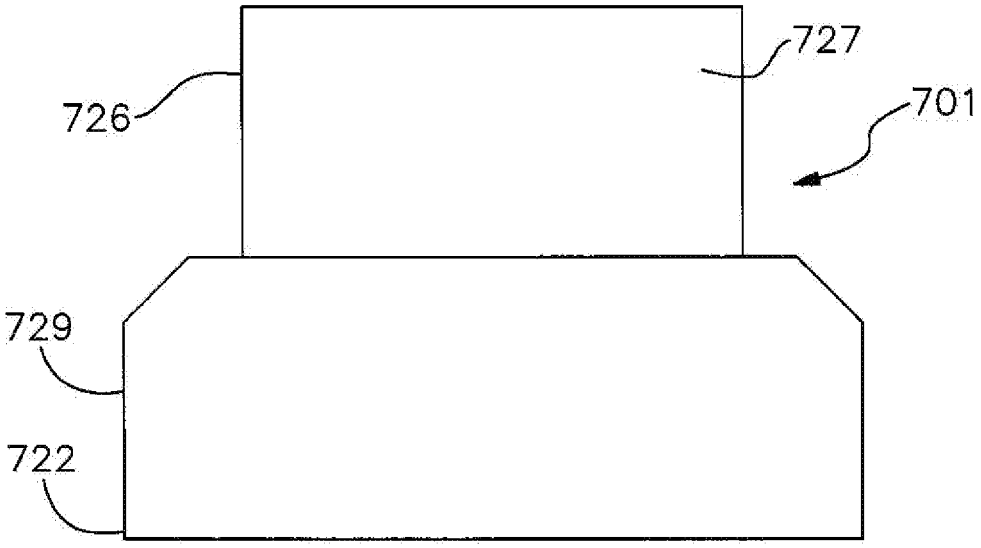
*Fig.* 21

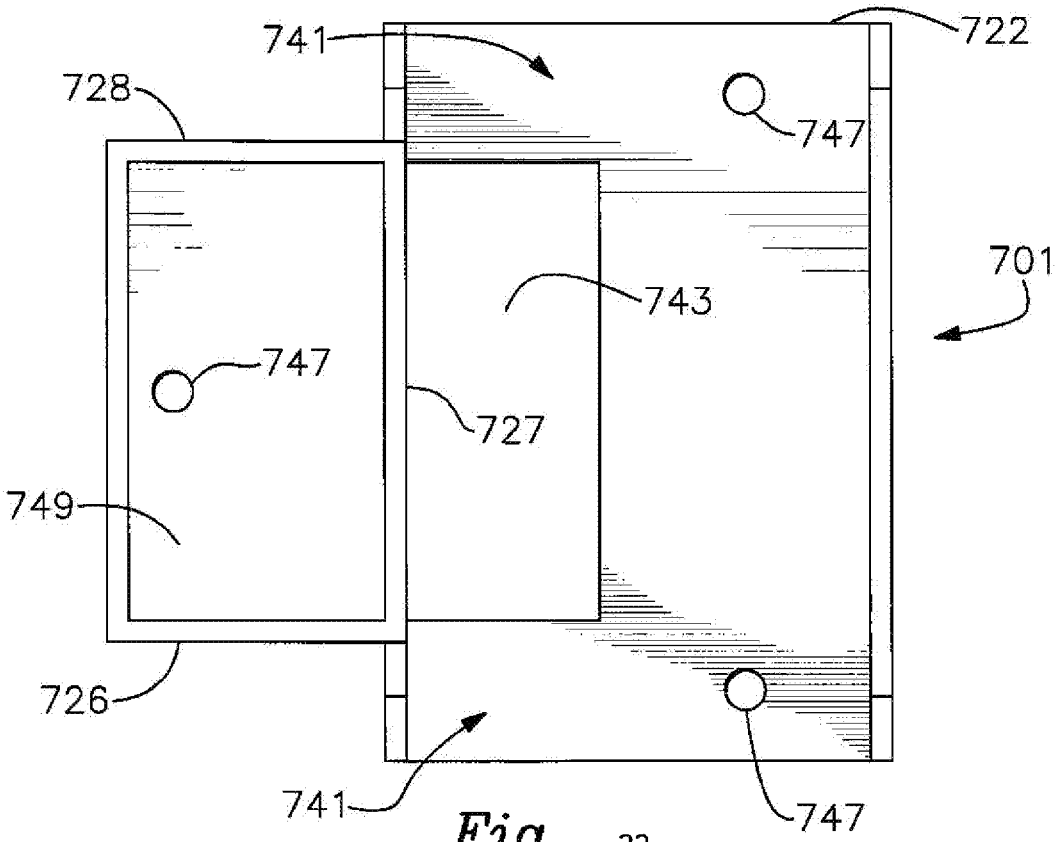
*Fig.* 22
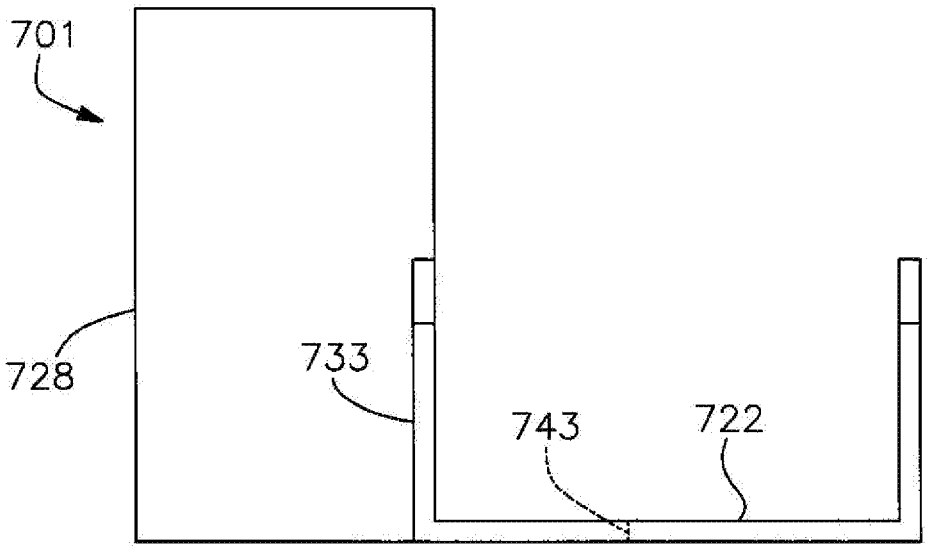
*Fig.* 23

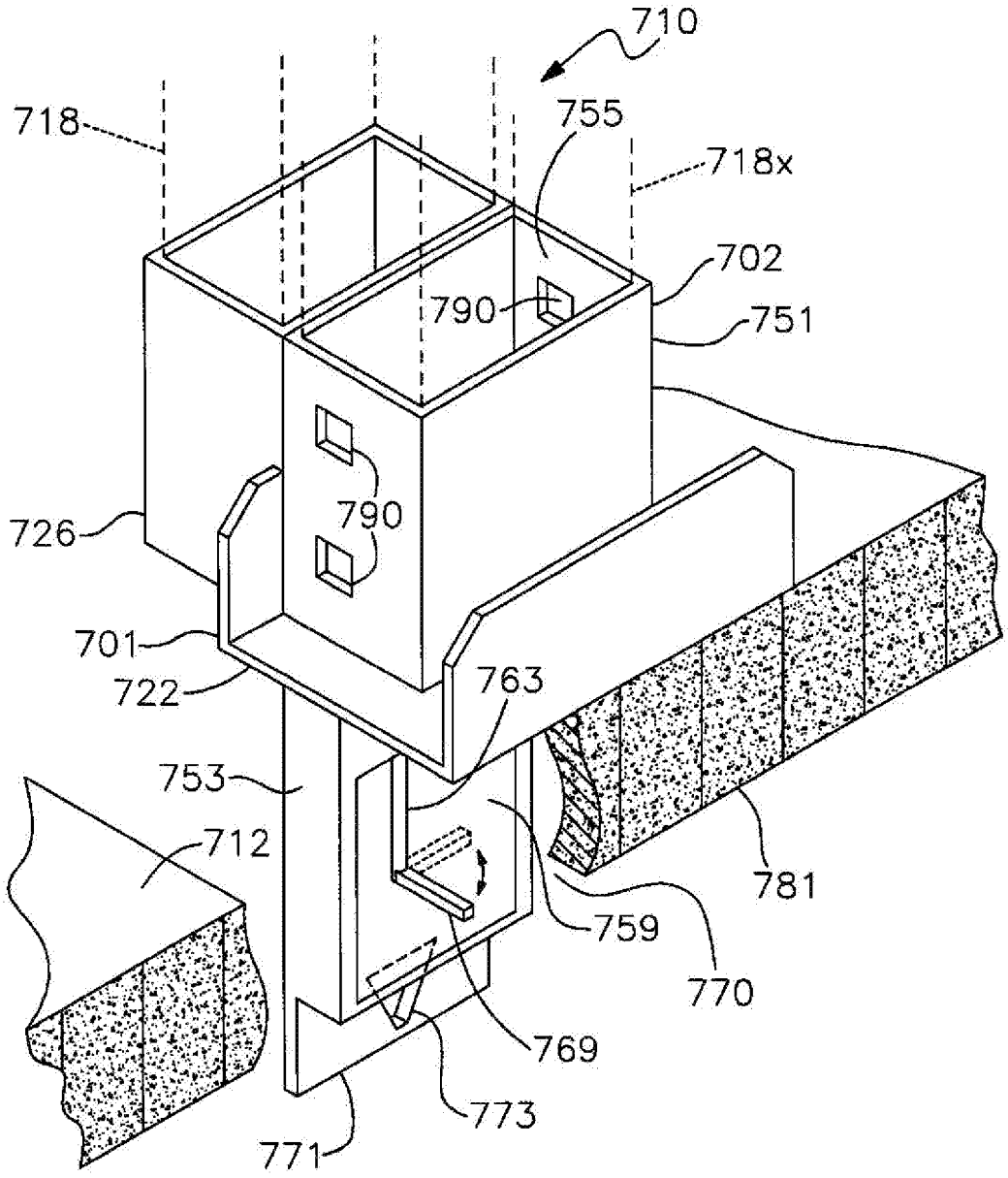
*Fig.* 26

SAFETY FENCE SUPPORT AND ANCHORING SYSTEM

RELATED APPLICATION

This is a continuation of application Ser. No. 14/943,351 filed Nov. 17, 2015.

FIELD OF THE INVENTION

This invention relates to a system for supporting the stanchions or posts of a guard rail or safety fence on an elevated deck, floor, slab or roof structure of a multi-level building. The system also provides one or more anchor points for various types of straps and safety attachments.

BACKGROUND OF THE INVENTION

Constructing a multiple level building commonly requires the use of OSHA mandated safety fences or guardrails installed temporarily along the edges of elevated work surfaces such as upper floors, decks, slabs, platforms, roofs and stairways. Such elevated building features are referred to collectively herein as "decks" and that term should be understood to include any generally horizontal or inclined building structure that supports construction workers and has opposing upper and lower surfaces. Conventional safety fences and guardrails employed on construction sites are intended to provide persons working on the building with at least some measure of protection against falls, at least until a surrounding wall or other restraint is completed. Temporary safety fences typically utilize a series of vertical posts or stanchions, and horizontal rails that interconnect the stanchions. Such fences may also include elongate toe boards that help prevent debris and/or work equipment from falling off of the elevated surface and presenting a serious safety hazard.

A variety of supportive devices have been developed for holding the upright posts or stanchions of a construction safety fence. As required by OSHA, these devices must be mechanically attached to the supporting deck structure. Although an assortment of clamps and brackets are available for this purpose, most safety fence mounting systems feature a base plate that is screwed or bolted by a tap-con or similar fastener to the underlying deck (which is itself typically composed of concrete). In an alternative technique, expansion anchors are drilled into the deck and the stanchion supporting device is bolted to the anchor itself.

To provide an acceptable degree of safety, the guardrail or safety fence must be fastened as securely as possible to the deck structure. The strength, safety and effectiveness of the fence is severely compromised if the fastening attachments are of poor quality or are not sufficiently strong for a particular application. By the same token, poor workmanship or installation equipment can reduce the extraction (removal) strength of the safety fence considerably. In any event, the effective strength of the fence is limited by the fracture strength of the tap-con, screw, bolt or other fastener. In many building construction applications, this has proven to be inadequate. Typically, the fastener is embedded only a short distance into the deck. In other cases, faulty equipment or poor workmanship causes mounting holes to be improperly sized. Either circumstance can cause the fastener to accidentally separate from the deck and thereby significantly weaken the safety fence.

An additional shortcoming of conventional stanchion or post mounting devices is that these devices do not provide a secure and conveniently accessible anchoring point for holding a safety strap and attached construction worker so that the worker is protected against potentially deadly falls. Conventional construction anchoring points are rarely installed near the perimeter of an elevated deck. Rather, they tend to be located near the center of the deck, slab or floor. As a result, safety lines attached to the anchoring point can pose a serious tripping hazard for workers. In addition, because safety lines cannot be practically or conveniently installed around the perimeter of an elevated deck, such lines cannot be easily extended and used effectively between different floors of a multiple level building. The versatility of known safety fence support systems is therefore quite limited.

SUMMARY OF THE INVENTION

It is therefore an object of the present invention to provide a safety fence support system that is anchored much more securely to an underlying deck structure than are conventional support systems and which effectively resists accidental extraction.

It is a further object of this invention to provide a safety fence support and anchoring system which significantly improves worker safety on an elevated deck of a multiple level building.

It is a further object of this invention to provide a multi-functioning stanchion support and anchoring system that serves as both a strong and effective stanchion support and a versatile anchoring point for securely holding attached safety lines and straps in a variety of configurations, orientations and arrangements that allow a construction worker to move more safely and securely about various levels of a multi-level building.

It is a further object of this invention to provide a safety fence support and anchoring system that is fixed more securely to an underlying deck structure and which features an increased fracture strength that is dependent on the strength of the deck structure itself rather than the strength of the fasteners fixed to the deck.

It is a further object of this invention to provide a safety fence support and anchoring system that permits workers' safety lines and straps to be fastened securely proximate the perimeter of an elevated deck rather than at an interior point of the deck so that tripping hazards are reduced and worker safety is improved.

It is a further object of this invention to provide a safety fence and anchoring system that uniquely allows workers to be securely anchored to an upper level of a building situated above the level on which the worker is working.

It is a further object of this invention to provide a safety fence support and anchoring system that may be mounted to and used effectively on a deck having an uneven or inclined upper surface.

It is a further object of this invention to provide a safety fence support and anchoring system featuring an angularly adjustable deck anchoring component that provides for improved versatility in mounting the system to a deck and anchoring safety straps and lines thereto.

It is a further object of this invention to provide a safety fence support and anchoring system that securely restrains a stanchion or post at both lower and upper ends thereof so that a stronger safety fence and improved worker security are achieved.

It is a further object of this invention to provide a safety fence support and anchoring system that effectively holds stanchions having various cross sectional configurations, sizes and lengths.

This invention features a support and anchoring system for a safety fence having at least one generally vertically oriented stanchion and for use in a building that includes an elevated deck supported above an underlying deck, which elevated deck has opposing upper and lower surfaces. The system includes a base plate adapted for being secured to the upper surface of the elevated deck. A stanchion receptacle is attached to and extends upwardly from the base plate for receiving and holding a stanchion such that the stanchion extends upwardly from the elevated deck. A deck penetrating anchor component is connected to and suspended below the base plate. The deck penetrating anchoring component is configured for being received by and constrained within a transverse opening formed through the elevated deck, which transverse opening extends fully through the elevated deck from the upper surface to the lower surface thereof. As a result, the deck penetrating anchor component is exposed through the lower surface of the elevated deck.

In a preferred embodiment, the base plate includes holes formed transversely therethrough for receiving respective connectors to secure the base plate to the elevated deck. The system may further include at least one toe rail retaining bracket attached to and extending upwardly from the base plate. The toe rail retaining bracket may be spaced apart from the receptacle to define a channel for receiving a toe rail therethrough. The toe rail retaining bracket may include at least one hole formed therethrough for receiving a respective connector to secure the toe rail bracket to a toe rail received by the channel.

An upper safety line anchoring component may be mounted above the base plate for attaching a worker protective safety line thereto. The deck penetrating anchor component may include a tubular member that is fixed to and depends vertically axially from a bottom surface of the base plate. The tubular member may have a circular or rectangular cross sectional configuration. The deck penetrating anchor component may carry a safety line anchoring bar that extends transversely through and is fixed interiorly within the tubular member for attaching a safety line thereto. A lower support plate may be attached interiorly to and extend downwardly from the tubular member. The system may further include a lower strap anchoring component carried by the support plate for attaching a safety line thereto. The lower support plate may include holes for receiving respective fastening elements for securing the lower support plate to a stanchion supported upon and extending upwardly from a support and safety system secured to the underlying deck.

A pivot mechanism may be provided for interconnecting the deck penetrating anchor component and the base plate. More particularly, the base plate may include a first pivot hole and the deck penetrating component may include a tubular element that carries a cap at an upper end thereof. The cap may include a second pivot hole formed therethrough. The pivot mechanism may include a pivot shaft that is received through and angularly pivotable within the first and second pivot holes. The pivot mechanism may further include a pair of shaft retaining elements attached at respective ends of the pivot shaft for restricting passage of the pivot shaft through the first and second pivot holes such that the deck anchor component is suspended pivotably from the base plate.

In an alternative two-piece version of this invention, the base plate and stanchion receptacle may comprise a single unitary stamped first piece of metal. The base plate may include a slot for receiving an elongate deck penetrating anchor component that may itself be composed of a single stamped second piece of metal. More particularly, the base plate may include a substantially flat bottom section that extends from a bottom of the stanchion receptacle for engaging the upper surface of the deck. An outer end of the base plate may be turned upwardly from the bottom section to define a toe rail retaining compartment between the stanchion receptacle and the upwardly turned outer end of the base plate.

In the two-piece version, the deck penetrating anchor component may include an upper support portion and an elongate anchoring portion that is attached to and depends from the upper support portion. In such versions the anchoring component is preferably inserted through both the slot in the base plate and the transverse hole in the deck such that the support portion engages the upper surface of the base plate and supports the depending anchoring portion below the deck. The anchoring portion may carry an adjustable locking mechanism that is alternatable between a closed condition to permit passage of the anchoring portion through the transverse hole in the deck and an open condition wherein the locking mechanism engages an opposite bottom surface of the deck to restrict removal of the anchoring component from the deck with which the anchoring component is engaged.

The individual components of the version described immediately above may alternatively be formed by welding or other well known manufacturing processes. Various types of lower safety line anchoring elements may also be carried by the anchor component of this version.

BRIEF DESCRIPTION OF THE DRAWINGS

Other objects, features and advantages will occur from the following description of a preferred embodiment and the accompanying drawings, in which:

FIG. 18 is a perspective view of a plug configured to form a rectangularly shaped cavity in a concrete deck structure for receiving a conformably shaped deck anchoring component;

FIG. 19 is a perspective view of a cylindrically shaped plug configured to form a conformably shaped opening in a concrete deck for receiving a cylindrically shaped penetrating anchor in accordance with that shown in FIG. 1;

FIG. 20 is a perspective view of a first piece of an alternative two-piece version of this invention, which piece includes a base plate, stanchion receptacle and toe rail receptacle, which are unitarily joined;

FIG. 21 is a front elevational view of the piece shown in FIG. 20;

FIG. 22 is a top plan view of the piece shown in FIGS. 20 and 21;

FIG. 23 is an elevational end view of the piece shown in FIGS. 20-22;

FIG. 26 is an upper perspective view of the system using the pieces shown in FIGS. 20-25 to securely support a stanchion above an underlying deck, which deck is depicted in cross section.

DETAILED DESCRIPTION OF PREFERRED EMBODIMENTS

Figure 7:
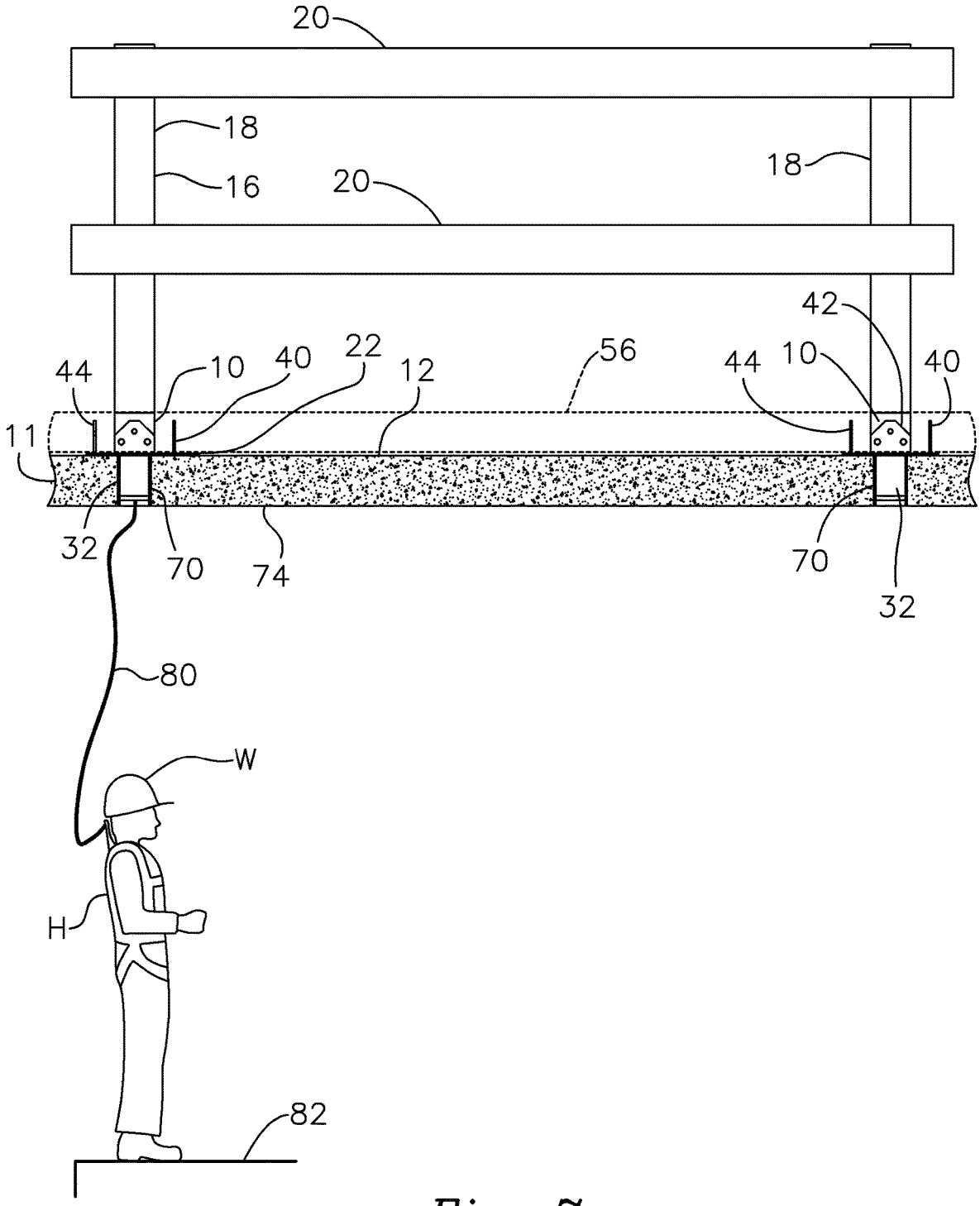
FIG. 7 is an devotional and partly cross sectional view of a construction safety fence supported by the system depicted in FIG. 1 and further illustrating a safety line anchored to the system for attaching to a harnessed construction worker on a lower level of a construction site.

There is shown in FIGS. 1-6 a support and anchoring system 10 for use on a construction site featuring a multiple level building that includes an elevated deck supported above an underlying deck. As used herein, the term "deck" should be construed broadly and includes any and all types of floors, slabs, roofs or similar structure that comprise respective supportive levels of a multi-level building. The elevated and underlying decks may be composed of concrete or various other known types of building materials. The composition of the deck should not be considered to be a limitation of this invention. As shown in FIG. 7, the elevated deck 11 has opposing upper and lower surfaces 12 and 14 respectively. Construction workers are supported on the decks of the building as they perform various construction tasks.

As is the common, if not standard practice in multi-level buildings undergoing construction, governmental (i.e. OSHA) regulations mandate that a guardrail or safety fence 16 be mounted at or near the edge of an elevated deck 11 on which work is being performed. Such safety fences 16 are intended to prevent workers from accidentally falling from an elevated deck and, as a result, suffering a potentially serious or even deadly injury. Most guardrails include a plurality of upright posts or stanchions 18 that support a plurality of substantially horizontally oriented rails 20. As used herein "stanchion" should be understood to include all types and constructions of posts, uprights, struts or other vertical components that comprise the guardrail and to which the horizontal rails are attached. The use of such safety fences and stanchions are commonplace and well known in the construction industry. To date, the stanchions have been secured to the elevated deck structure by various types of mounting systems. System 10 of the present invention is designed to provide an improved and versatile means for mounting the stanchions as well as for anchoring safety lines used by workers on the elevated and lower decks or levels of the building. Each system or device 10 is associated with a respective stanchion as will be explained below.

As shown in FIGS. 1-6, system 10 includes a substantially flat base plate 22. In the versions depicted herein, the base plate has a rectangular configuration, although alternative shapes and various sizes may be employed within the scope of this invention. Base plate 22 has one or more holes 24 formed therethrough for securing the base plate to an underlying deck, as is described more fully below. Although only a single mounting hole is depicted in FIGS. 1-6, alternative embodiments may utilize other numbers of holes in accordance with this invention.

A stanchion accommodating receptacle 26 is fixed to and extends upwardly from a top surface 28 of base plate 22. Receptacle 26 has a generally rectilinear shape and conformably receives a piece of lumber of other elongate component comprising the stanchion. Receptacle 26 and its central opening 30 may have various dimensions and configurations for accommodating assorted stanchion shapes and sizes. Receptacle 26 and base plate 22 may be composed of steel or other strong and durable materials. When steel is used, the receptacle is typically welded or otherwise permanently secured to the base plate.

System 10 also includes a cylindrically shaped deck penetrating anchor component 32, which again comprises steel or similar material. Anchor component 32 is preferably welded to a bottom surface 34 of base plate 22 and suspended below the base plate. Component 32 may have various diameters and lengths. However, in all cases, the penetrating anchor component 32 should be long enough to extend fully through the elevated deck to which system 10 is mounted. This will be shown and described more fully below.

Figure 1:
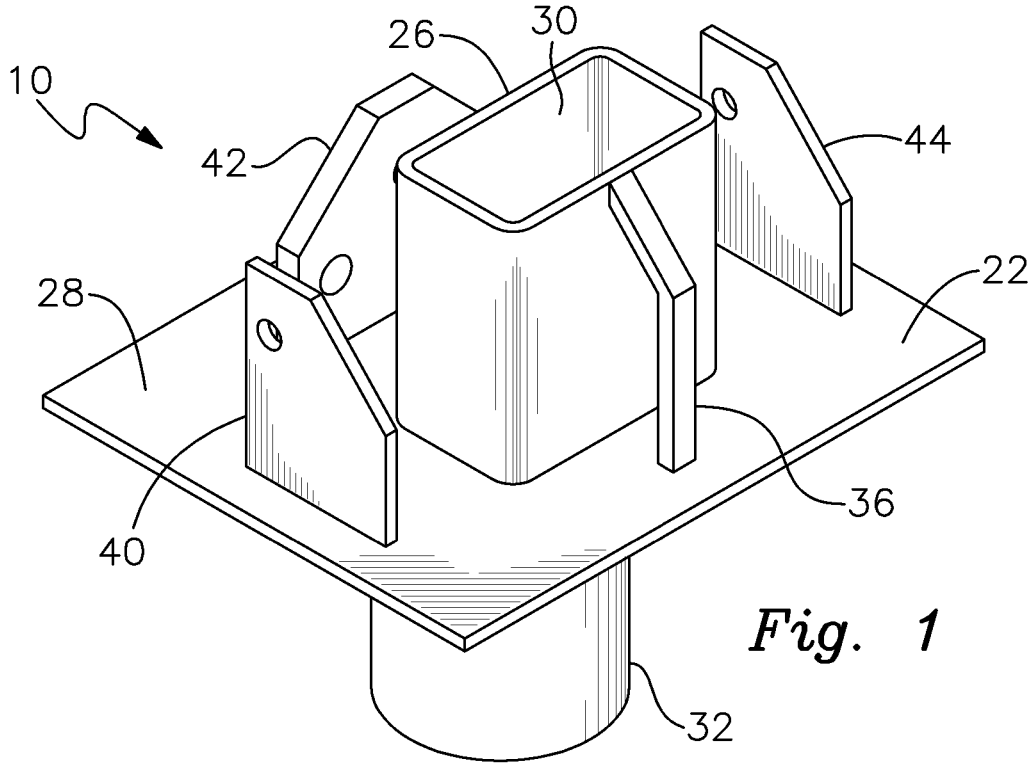
FIG. 1 is a top perspective view of a preferred safety fence support and anchoring system in accordance with this invention.
Figure 2:
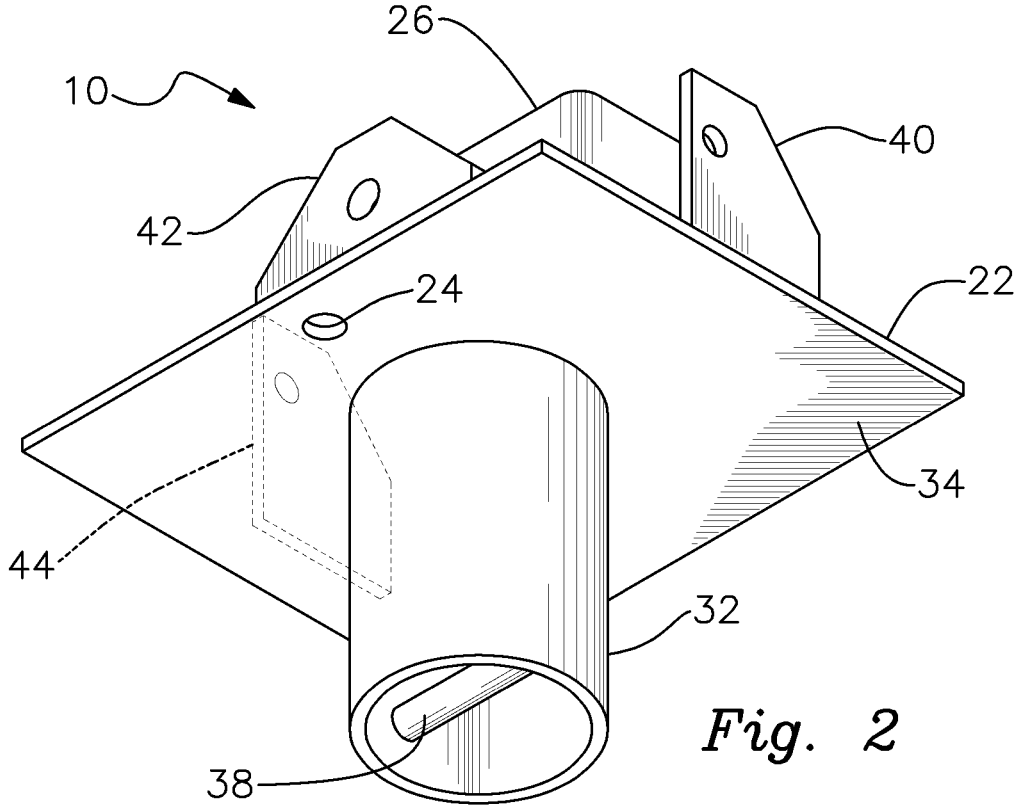
FIG. 2 is a bottom perspective view of the system of FIG. 1.
Figure 3:
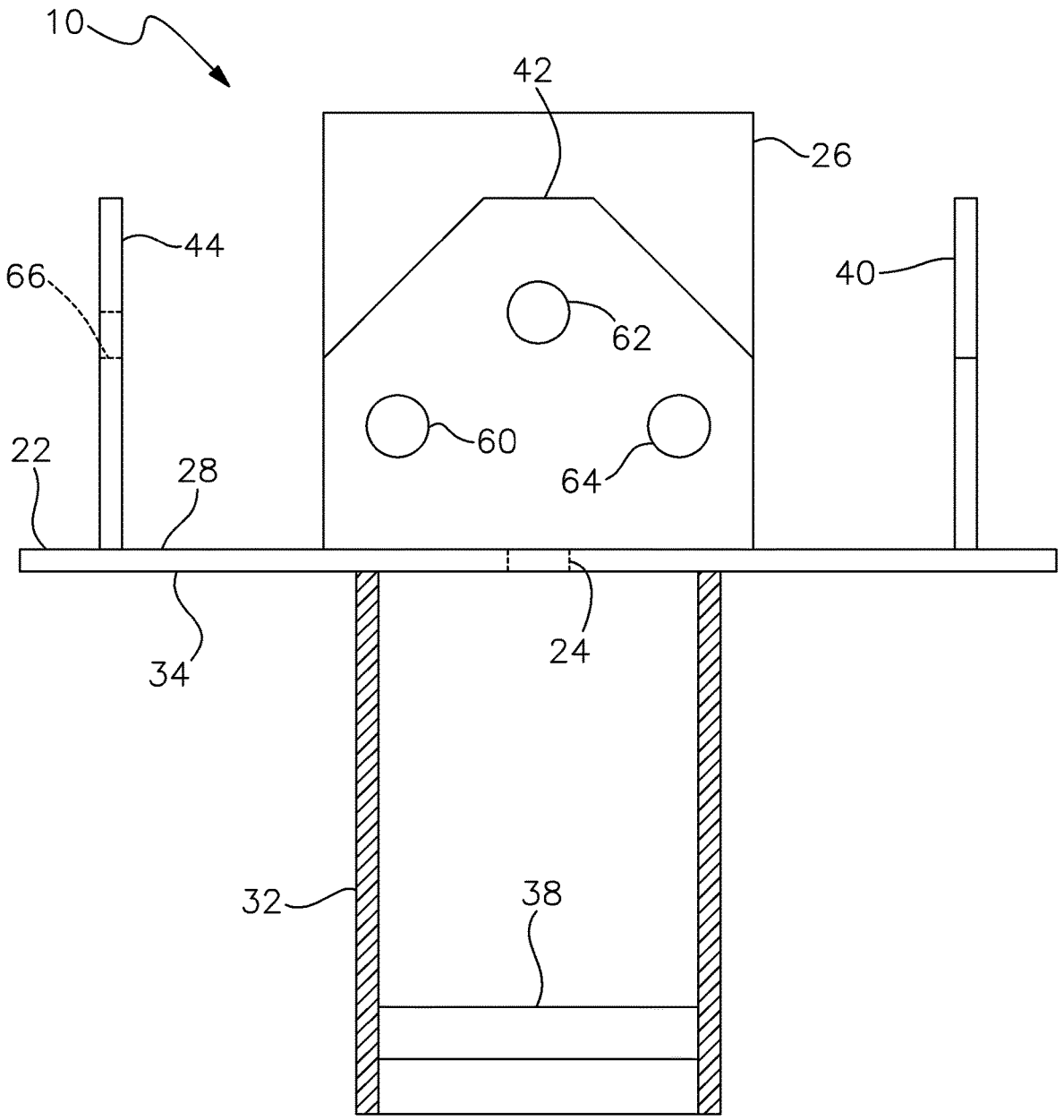
FIG. 3 is a front elevational and partly cross sectional view of the preferred support and anchoring system.
Figure 4:
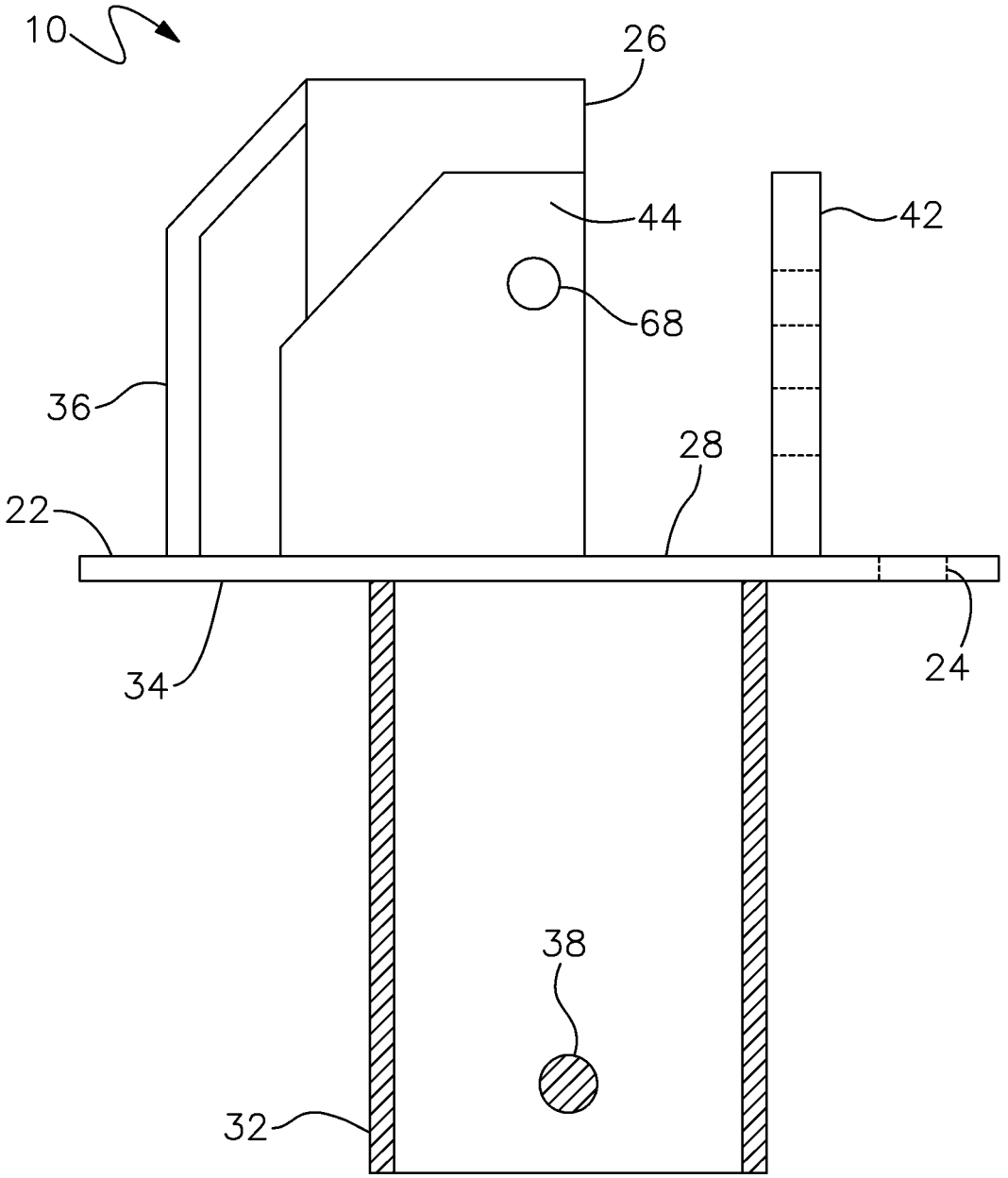
FIG. 4 is an elevational and partly cross sectional side view of the preferred system.
Figure 5:
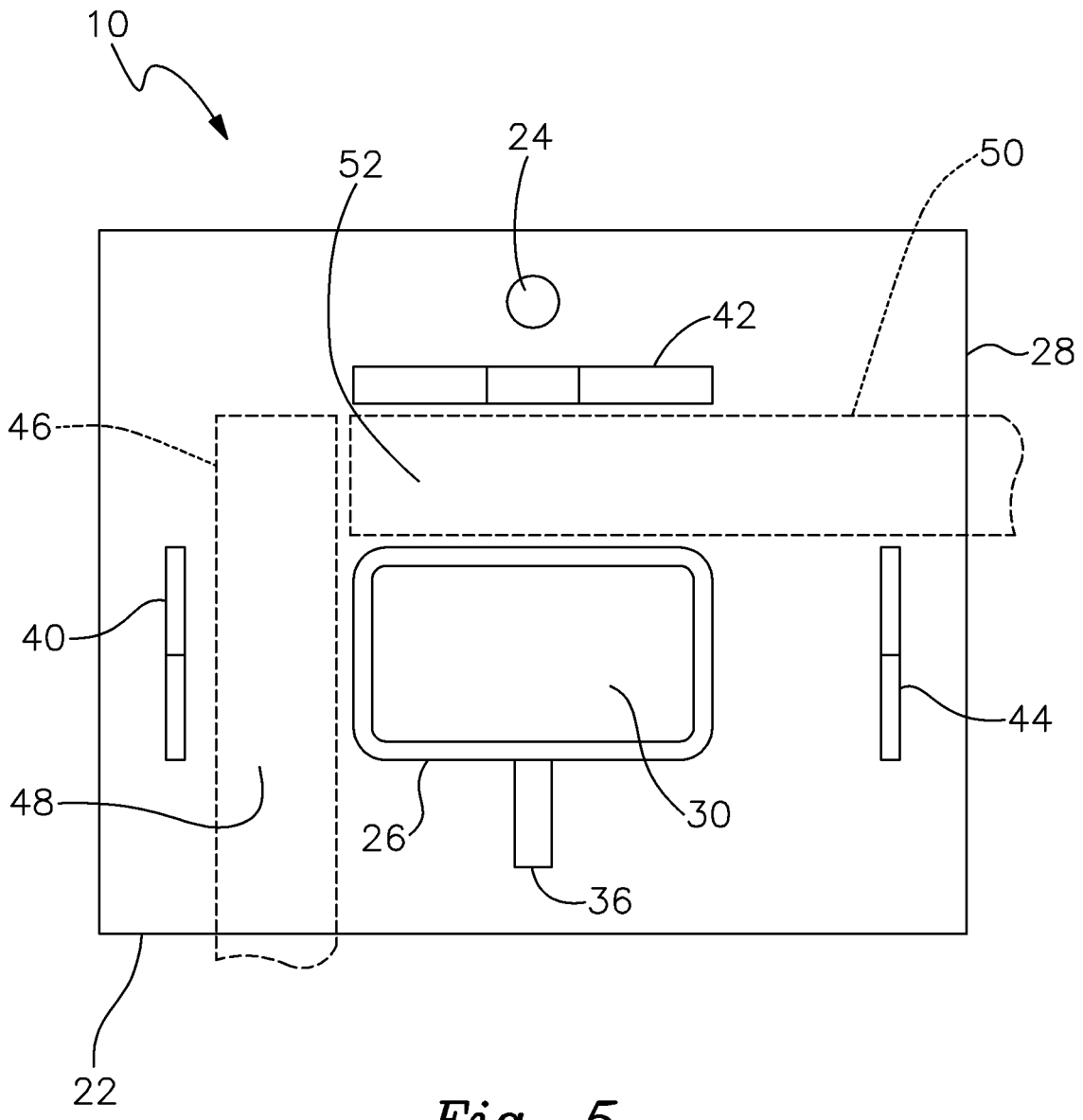
FIG. 5 is a top plan view of the preferred system.
Figure 6:
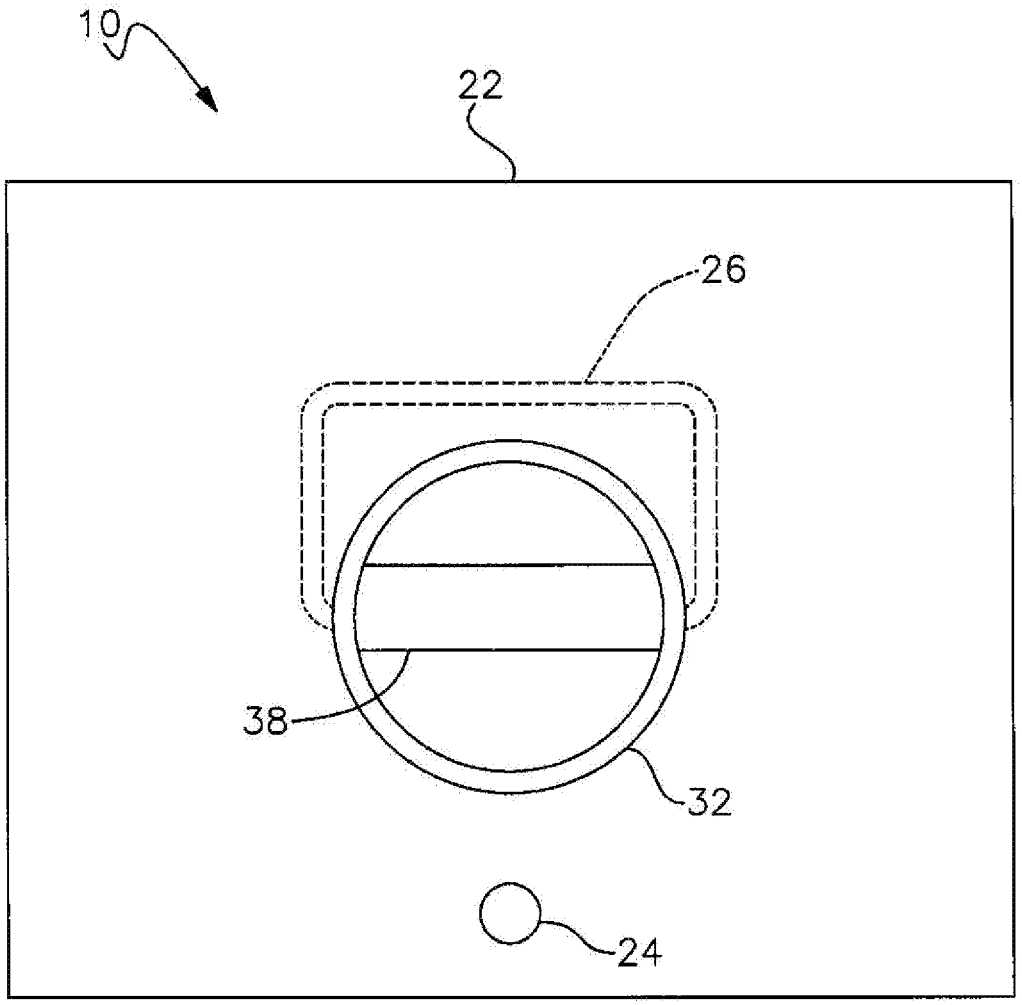
FIG. 6 is a bottom plan view of the preferred system.

System 10 also includes various upper and lower safety line anchors. In particular, an upper safety line anchor 36, best shown in FIGS. 1, 4 and 5, is interconnected between an upper surface 28 of base plate 22 and an upper portion of receptacle 26. This component not only serves as an anchor point for a safety line, as is illustrated below, it also serves as a handle for conveniently carrying and positioning system 10 during installation or removal of the support and anchoring system. Likewise, a lower safety line anchor 38 best shown in FIGS. 2, 3 and 4, is mounted within and extends across the central opening of tubular deck penetrating anchor 32. Lower anchor 38 comprises a rod or bar that is fastened securely to the interior of anchor component 32 proximate the lower distal end of the deck penetrating anchor. Both the upper anchor 36 and the lower anchor 38 are preferably composed of steel or other durable metals and are welded or analogously fixed to the stanchion supporting receptacle and deck penetrating anchor component respectively.

As further shown in FIGS. 1-6, three toe rail retaining brackets 40, 42 and 44 are attached to and extend upwardly from surface 28 of base pate 22. In particular, brackets 40 and 44 are parallel to one another and oriented substantially perpendicularly to bracket 42. Each of the brackets is substantially parallel to a respective side of rectilinear support receptacle 26. As a result, a gap is formed between each bracket and its respective parallel side of receptacle 26 for accommodating a respective toe rail. The triple retaining bracket construction shown herein allows system 10 to be employed at either the corner of an elevated deck or at intermediate locations along a side edge of the deck. This is shown or described more fully below. The toe rail retaining brackets are again preferably composed of steel or other strong and durable materials. Steel retaining brackets are typically welded to an upper surface of the plate. Each toe rail retaining bracket includes one or more mounting holes for accommodating screws or analogous fasteners that secure respective toe rails to the retaining brackets. For example, bracket 42 includes three holes 60, 62 and 64 (FIG. 3). Brackets 42 and 44 feature single mounting holes 66 and 68, respectively. Various configurations for attaching the toe rails to system 10 are again, described below.

System 10 is installed and utilized in the manner shown in FIG. 7. Therein, a pair of support and anchoring systems 10 support respective stanchions 18 of a safety fence 16 to mount the fence along a side edge of an elevated deck 11. In particular, each system 10 is engaged with deck 11 such that its base plate 22 engages and lies flat against the upper surface 12 of deck 11. Deck penetrating anchor component 32, which is suspended from the lower surface of the base plate, is received by and constrained within a respective transverse opening 70 formed through deck 11. Each opening 70 extends from upper surface 12 to lower surface 14 of the deck. The lower distal end of the installed deck penetrating anchor component 32 may be positioned precisely at, somewhat above or somewhat below lower deck surface 14. In any event, opening 70 is formed to extend fully through deck 11 so that the deck penetrating anchor component is exposed and made accessible (to workers on lower deck 82) through lower deck surface 14. Transverse opening 70 is formed so that it substantially conforms to the circumferential shape of anchor component 32. In addition, base plate 22 is further secured to deck 11 by screws or other fasteners which are engaged through mounting hole 24 (FIG. 5). This attaches the support and anchoring system 10 securely to the elevated deck. The conforming fit between deck penetrating anchor component 32 and transverse hole 70 restricts or constrains movement of the support and anchoring system upon the deck. Bolting or otherwise securing the base plate to the deck further limits any unintended rotation or other movement of system 10 relative to the deck.

With multiple systems 10 installed in the foregoing manner, the stanchions 18 of fence 16 can be in respective receptacles 26. Additional sections of safety fence may be installed in an analogous manner. The assembled fence is thereby supported in a much stronger and more secure manner than provided by the prior art. In particular, the mounting system is much less apt to accidentally detach from the deck 11 than are systems of the prior art, where the strength of the system is dictated by the strength of the screws or other fasteners attached along the edge of the deck. In the present invention, the strength of the mounting system and the entire safety fence rely upon the structural integrity and strength of the underlying deck itself. This is because the deck penetrating anchor is mounted within an opening that extends fully through the deck. The deck penetrating anchor and complementary deck opening are configured to have generally conforming shapes, which constrain unintended movement of the support system about the deck.

FIG. 7 also depicts a toe rail 56, shown in phantom and engaged with adjoining systems 10 installed in deck 11. In particular, a lower edge of toe rail 56 engages the base plate of each system 10 and extends through a gap formed between each retaining bracket 42 and the respective parallel side of receptacle 26. In this application, wherein the respective stanchions 18 are holding the safety fence along a side edge of the deck 11, only respective retaining brackets 42 used. The perpendicularly oriented brackets are not required and, rather, are utilized in corner mounting applications described more fully below. In the version shown in FIG. 7, screws or other fasteners are engaged with one or more of the openings 60, 62 and 64 (and typically only central opening 62) to secure the toe rail 56 to the retaining brackets 42 of respective systems 10. With toe rail 56 so installed, tools and other small items are prevented from accidentally slipping, rolling or otherwise falling off of the elevated deck 11. In other embodiments a pair of aligned toe rails may be abutted end to end within a single retaining bracket 42. In such cases, each of the abutting toe rails is secured to bracket 42 by a fastener installed through a respective fastening hole 60, 64 (FIG. 3).

Figure 8:
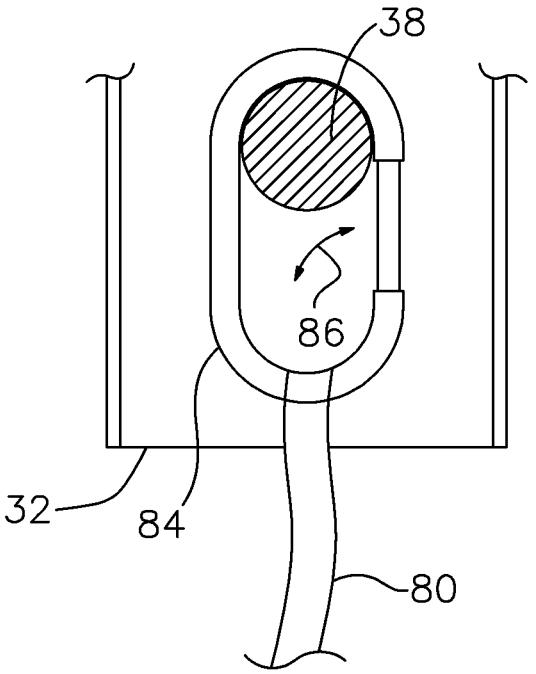
FIG. 8 is a cross sectional view of the upper end of a safety line anchored to the support and anchoring system by means of a releasable clip.

It is critical to this invention that the transverse deck openings 70 extend fully through the deck from the upper surface 12 to the lower surface 14 so that deck penetrating anchor component 32 is exposed from below. This advantageously allows the lower safety line anchor bar or rod 38 to be accessed and engaged by a safety line 80 as shown in FIG. 7. This safety line may comprise a strap, cable or other means of attachment which is interconnected such as by a harness H to a worker W located on a lower or underlying deck 82 of the building. As shown in FIG. 8, anchor rod 38 extends transversely across the central opening of the cylindrical anchor component 32. Workers located on underlying deck 82 are thereby provided with easy and convenient access to anchor rod 38. For example, a standard clip 84 at one end of safety line 80 may be pivoted open, as indicated by double headed arrow 86, and engaged with anchor rod 38. This securely tethers and anchors worker W to anchoring rod 38 so that safety is improved for worker W on underlying deck 82.

Figure 9:
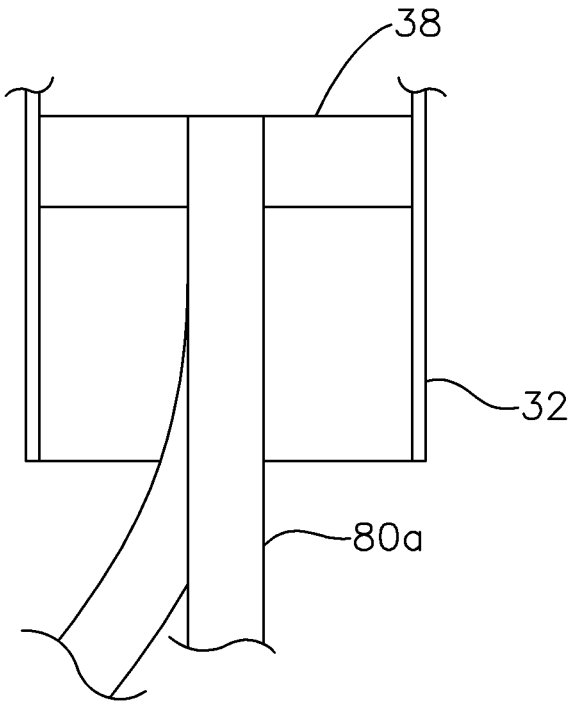
FIG. 9 is a cross sectional view depicting the upper end of an alternative safety line secured to the anchoring and support system by wrapping a strap about an anchoring bar formed through the deck penetrating anchor of the system.

FIG. 9 depicts an alternative version wherein a safety strap 80*a* is wrapped about and secured to lower anchoring rod 38 within anchoring component 32. Similar benefits are provided as in the immediately preceding embodiment. It should be understood that as used herein "safety line" refers to all manner and means of safety attachments including, but not limited to lines, cords, straps, cables etc.

Figure 10:
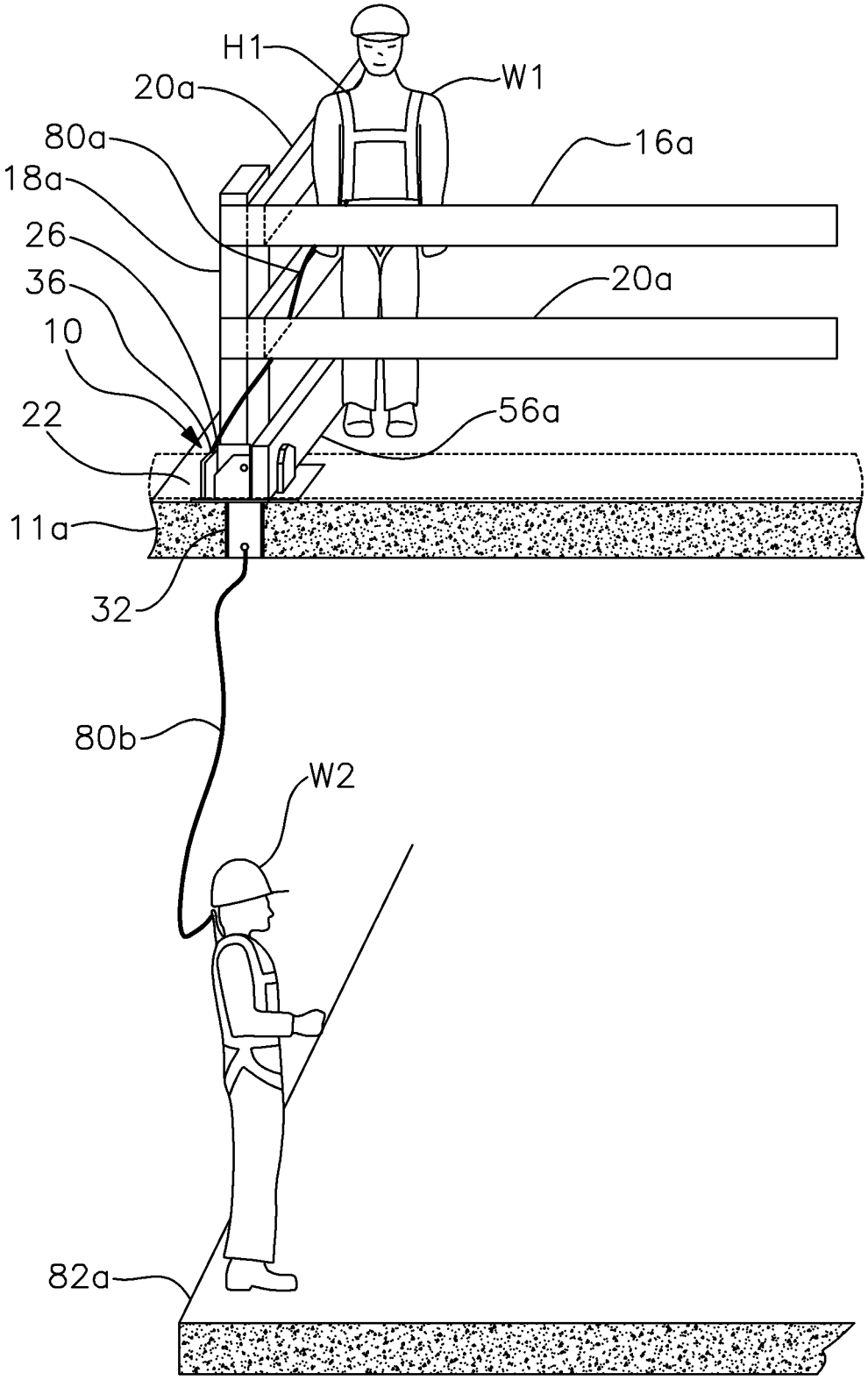
FIG. 10 is a perspective view of the support and anchoring system of this invention mounted proximate a corner of an elevated deck for supporting a respective corner of a safety fence or guardrail and further illustrating a safety line anchored to the deck penetrating anchor of the system for tethering to a construction worker located on a lower level or deck of the building.

FIG. 10 illustrates a single mounting system 10 in accordance with this invention installed at a corner of an upper or elevated deck 11*a*, which is in turn supported above an underlying deck 82*a*. The elevated deck is supported above the underlying deck by any one of various known types of multi-level building construction. A safety fence or guard rail 16*a* is mounted to the concrete slab or deck 11*a* by a plurality of the anchoring and support systems 10 that have been previously described. In FIG. 10 only a single system 10 is illustrated for mounting a corner stanchion 18*a* of safety fence 16*a*. Additional stanchions, which are not shown, may be mounted to the concrete deck 11*a* by respective systems formed along the perpendicularly connected edges of deck 11*a* in a manner analogous to the support and anchoring systems 10 shown in FIG. 7.

System 10 once again features a base plate 22 that is bolted or otherwise secured to the upper surface of deck 11*a*. A generally tubular penetrating anchor 32 is received within a conformably shaped hole formed through deck 11*a* and extending from the top surface to the bottom surface of the deck. As a result, anchor 32 is constrained within the transverse hole formed through the deck. Each support and anchoring system holding fence 16*a* is secured to deck 11*a* in a similar fashion.

System 10 again includes an upper receptacle 26 that receives a respective stanchion 18*a*. The stanchion has a cross section that is conformably shaped to fit relatively snugly within the opening of receptacle 26. Horizontal rails 20*a* are interconnected to and extend between respective stanchions of the fence. By the same token, perpendicularly oriented toe rails 56*a* are supported within respective channels defined by toe rail brackets 40, 42 and 44. At the corner device 10 depicted in FIG. 10, the perpendicularly engaged toe rails 56*a* are received, for example, in the channels formed by toe rail retaining brackets 40 and 42. See also the perpendicular orientation of toe rails 46 and 50 relative to those brackets in FIG. 5. Along the respective edges of the deck 11*a*, the toe rails may be supported by toe rail brackets 42 in the manner shown in FIG. 7. Screws are engaged with the holes 60, 62 and 64 (FIG. 3) of the toe rail brackets and the accommodated toe rails to secure the toe rails to the support and anchoring system 10.

As further shown in FIG. 10, upper anchor handle 36 provides for a secure and readily accessible anchor to which the appropriate clip of a safety line 80*a* may be secured. The opposite end of safety line 80*a* is secured in a known and appropriate manner to the harness H1 of a worker W1 located on elevated deck 11*a*. Other workers may be similarly tethered to anchor handle 36 or to the anchor handle associated with another device 10 mounted to upper deck 11*a*. As a result, the safety lines 80*a* are securely fastened to the anchor and support system 10 and are readily accessible by workers on the elevated deck so that the safety lines may be engaged with and disengaged from the support and anchor systems as needed. The risk of accidental falls and resultant injuries are thereby reduced significantly.

FIG. 10 further depicts another construction worker W2 engaged in a task on an underlying or lower deck 82*a*. As in the version shown in FIG. 7, worker W2 is protectively tethered to the building structure by a safety line 80*b*. The upper end of safety line 80*b* is clipped to the lower anchor mounted interiorly within tubular penetrating anchor 32 in the manner previously described in connection with FIG. 7. In this manner, workers W2 who are working on the underlying deck 82*a* are similarly protected against accidentally falling from that deck. It should be understood that level 82*a* may also be fitted with its own guardrail or safety fence and associated support and anchoring systems, which are mounted in respective openings formed fully through deck 82*a*. This form of mounting is analogous to that shown for mounting the support and anchoring system 10 shown in FIG. 7.

Figure 11:
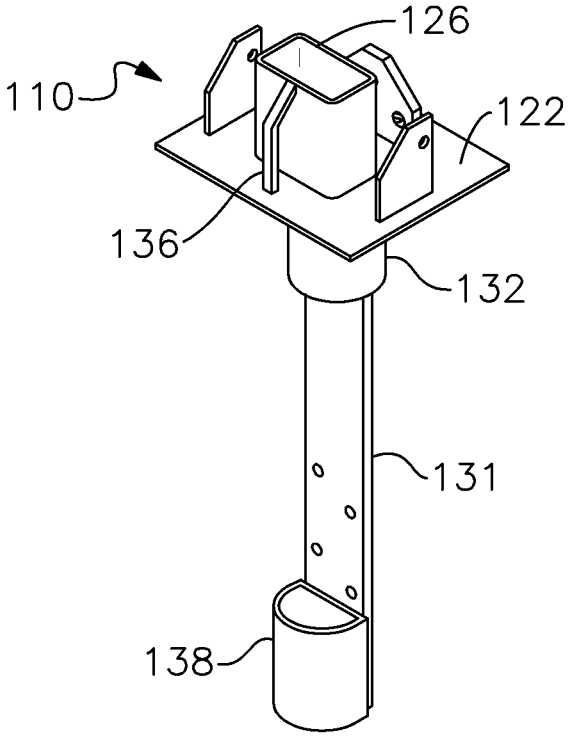
FIG. 11 is a top perspective view of an alternative version of this invention wherein the deck penetrating anchor carries a depending support plate that, in turn, supports a semi-circularly configured lower safety line anchor proximate its bottom end.
Figure 12:
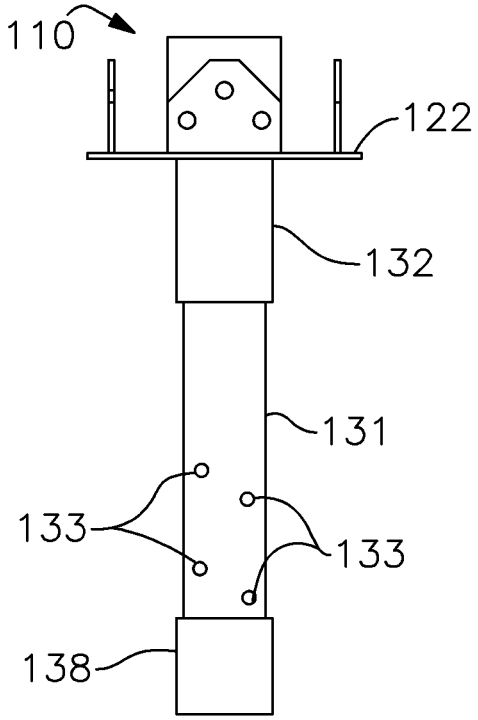
FIG. 12 is a lower perspective view of the system of FIG. 11.

FIGS. 11 and 12 illustrate an alternative support and anchoring system 110 featuring a generally horizontally oriented base plate 122 for engaging and securing to the top surface of a deck or slab to which a guardrail or safety fence is to be mounted. A post or stanchion holding upper receptacle 126, which again has a generally rectangular cross sectional shape, is attached to and extends upwardly from base plate 122. An upper handle defining an anchor 136 is connected between and fixed to an upper surface of plate 122 and an outer side wall of receptacle 126. A deck penetrating anchor 132 is joined permanently to a bottom surface of plate 122 and extends vertically downwardly therefrom. The version in FIGS. 11 and 12 features an elongate support plate 131 that is welded along its edges to the interior of anchor 132 and extends downwardly therefrom. Plate 131 includes a plurality of fastening holes 133, which are engaged by screws or other fasteners to secure plate 131 to a stanchion mounted on the underlying deck. A lower safety line anchor 138, which has a generally semi circular cross sectional configuration, is welded or otherwise fixed securely proximate a lower end of elongate element 131.

Figure 13:
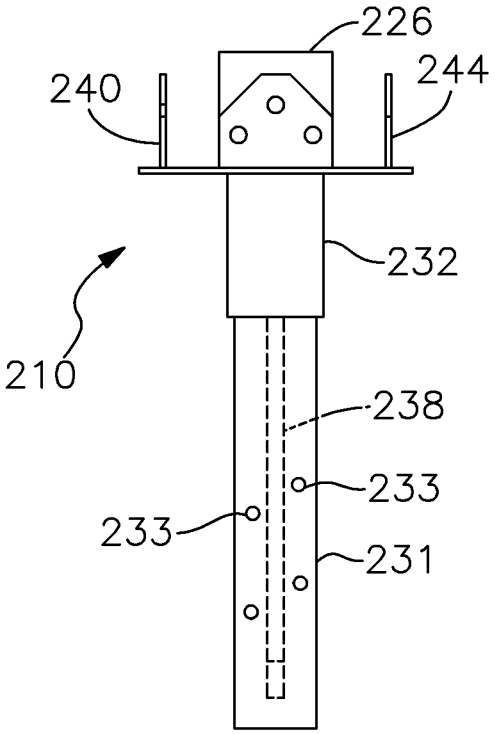
FIG. 13 is a lower perspective view of an alternative version of the support and anchoring system featuring an elongate safety line anchoring component mounted to the depending support plate.
Figure 14:
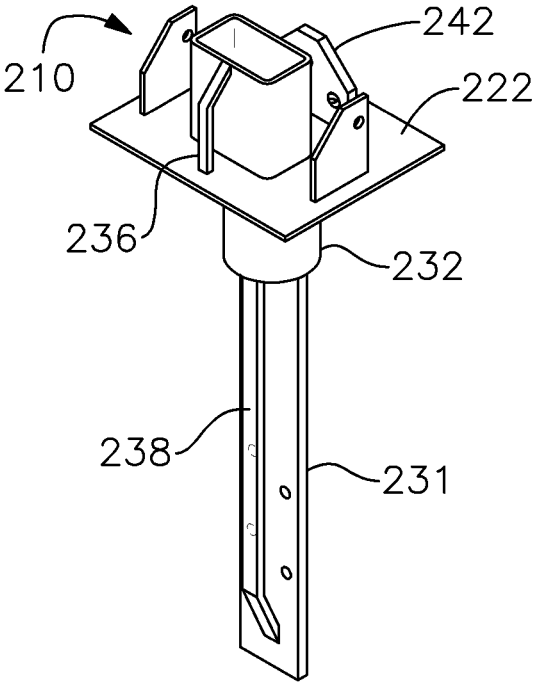
FIG. 14 is a top perspective view of the system shown in FIG. 13.

As shown in FIGS. 13 and 14, support and anchoring system 210 again includes an upper portion featuring a stanchion holding receptacle 226, at least several toe rail retaining brackets 240, 242 and 244 and the mounting holes formed therein. These components operate analogously to the correspondingly named pieces and parts shown in the prior embodiment. In the embodiment of FIGS. 13 and 14, an elongate lower safety line anchor 238 extends from the inside circumferential surface of deck penetrating anchor 232 to a lower portion of support plate 231. The previously described lower anchor 138, FIGS. 11 and 12, is eliminated and replaced by elongate lower anchor 238 fastened at respective ends to the lower end of plate 231 and an interior surface of tubular penetrating anchor 232 by welding or analogous means. Once again, mounting holes 233 are formed in the lower support element.

Figure 15:
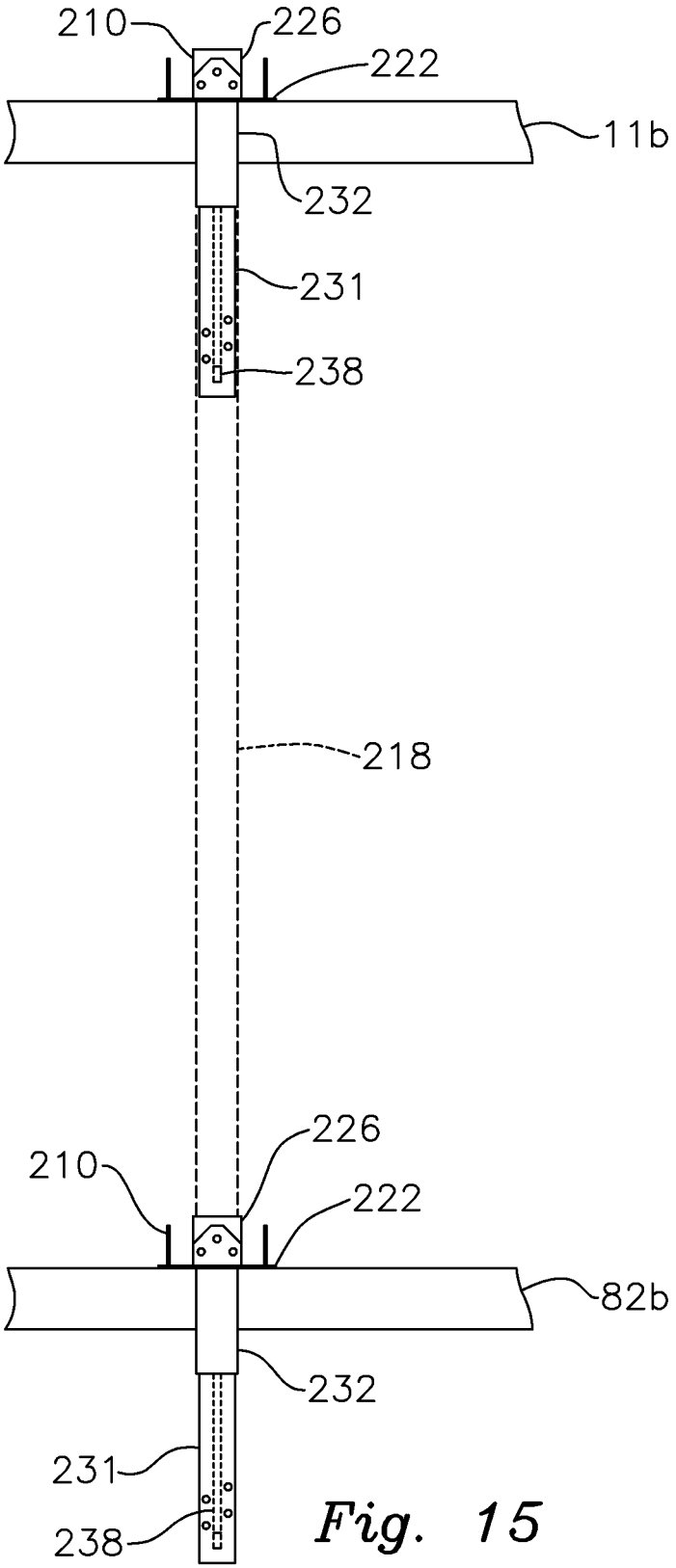
FIG. 15 is an elevational front view of the embodiment of the system depicted in FIGS. 13 and 14 as mounted on successive levels of a building and supporting a vertical stanchion or post between those levels.

Support and anchoring systems 110 and 210 may be used in a manner similar to that previously described to support a guardrail or safety fence between two decks of a multi-level building. In particular, as shown in FIG. 15 a first anchoring and support system 210 is mounted to elevated deck 11*b* and a second support and anchoring device 210 is similarly mounted to an underlying deck 82*b*. As in the previously described embodiments, the generally tubular penetrating anchor 232 extends through a conformably shaped hole formed from top to bottom through decks 11*b* and 82*b* respectively. The base plate 222 of each system is secured to an upper surface of the respective deck. As a result, a stanchion holding receptacle 226 extends upwardly from the upper surface of each deck. By the same token, an elongate lower support plate 231 is suspended from each penetrating anchor 232 below each deck. Each plate 231 carries a respective lower anchor handle 236. A stanchion 218 of a guardrail is mounted between the successive levels by securing a lower end of the stanchion into the support receptacle 226 of the lower system 210. The depending support plate 231 of the system 10 mounted on upper deck 11*b* engages and is secured to an upper end of stanchion 218. In particular, plate 231 fleshly engages a flat surface of stanchion 218 and the plate is secured to the stanchion by bolts or screws inserted through mounting holes 233. It should be understood that the guardrail may also include horizontal rails and toe rails (not shown) which are attached to the stanchion and engaged with the toe rail brackets of device 210 mounted on deck 82*b* in a manner previously described. The lower anchor handles 238 of respective devices 210 provide for secure and accessible overhead anchoring points for workers located on the upper surface of deck 82*b* and on the deck or level immediately below deck 82*b*.

Figure 16:
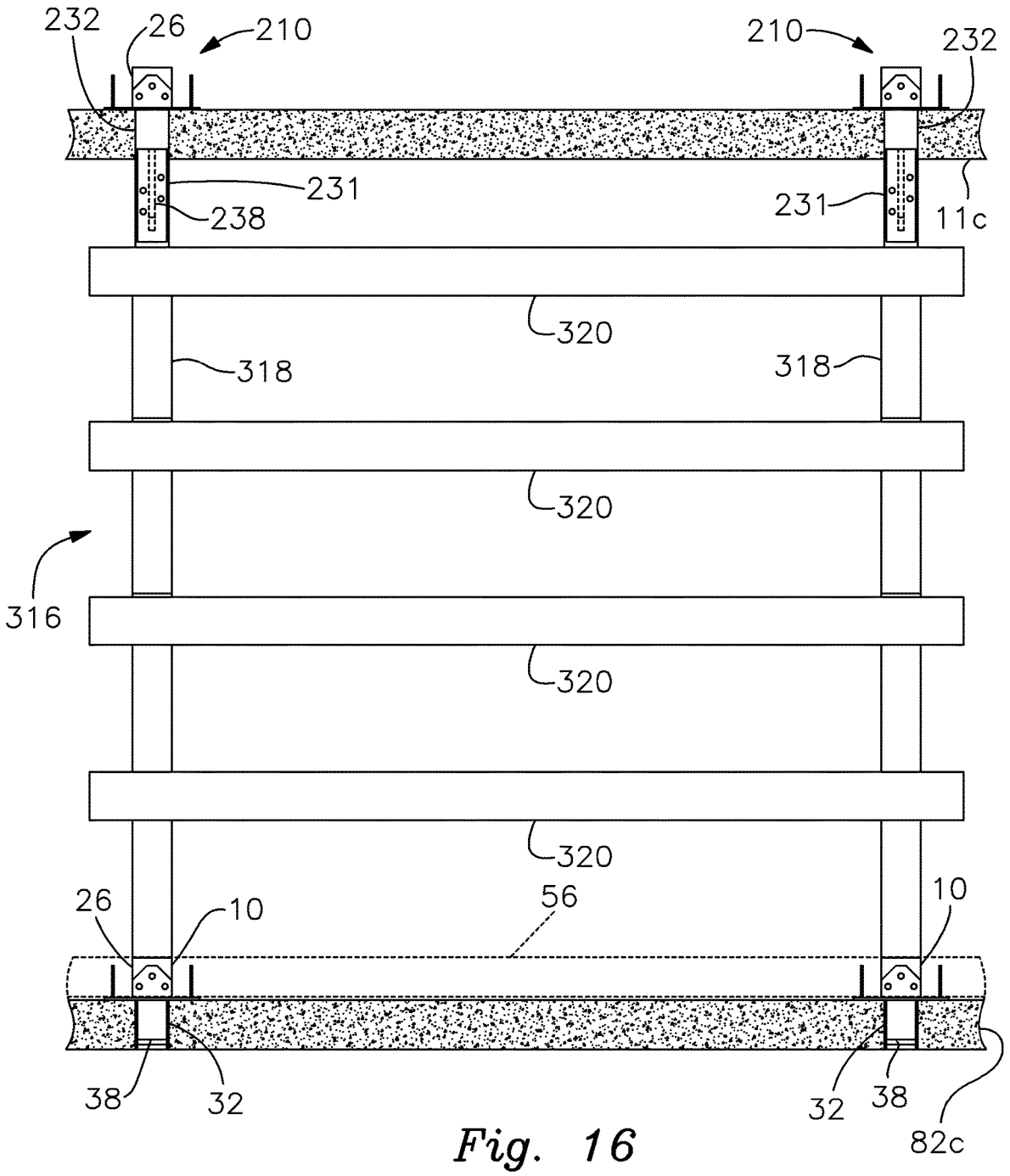
FIG. 16 is an elevational, partly cross sectional view of the embodiment of the support and anchoring system shown in FIGS. 13 and 14 as used to support a safety fence that extends fully between successive levels of a multi-level building.

FIG. 16 depicts a safety fence or guardrail 316 that is mounted on underlying deck 82*c* and extends upwardly to the bottom surface of elevated deck 11*c*. The guardrail comprises vertical stanchions 318 and a series of horizontal rails 320 mounted between the stanchions. In this version, the lower end of each stanchion 318 is received and supported in the receptacle 26 of a respective support and anchoring system 10 as previously shown and described in FIGS. 1-10. The upper end of each stanchion is fastened to the depending support plate 231 of a respective support and anchoring system 210 in the manner shown and described in FIG. 15. A toe rail 56 is engaged with the lower systems 10 in a manner as previously described. This provides for an extremely strong and reliable safety fence that is fastened securely at both its upper and lower ends. The strength of the system is defined by the fracture or removal strength of the penetrating upper and lower anchors 232 and 32 respectively.

Additional sections of the guardrail may be added and installed in a like manner. As previously described, the upper anchor handle (obscured in FIG. 16 but see handle 236 in FIG. 14) as well as lower anchor handle 238 or lower anchor rods 38 provide for secure and easily accessible anchoring point s for persons working on decks 11*c* and 82*c* as well as on the deck immediately below deck 82*c*.

It should be understood that in various applications, the embodiment disclosed in FIGS. 11 and 12 may be substituted for the version shown in FIGS. 13 and 14. In that case, a lower anchoring point is provided by the semi-cylindrical anchor 138. A safety line and respective attachment clip may be wrapped about anchor 138 and secured thereto to provide a secure and accessible anchor point for workers located on an underlying deck, slab or level.

Figure 17:
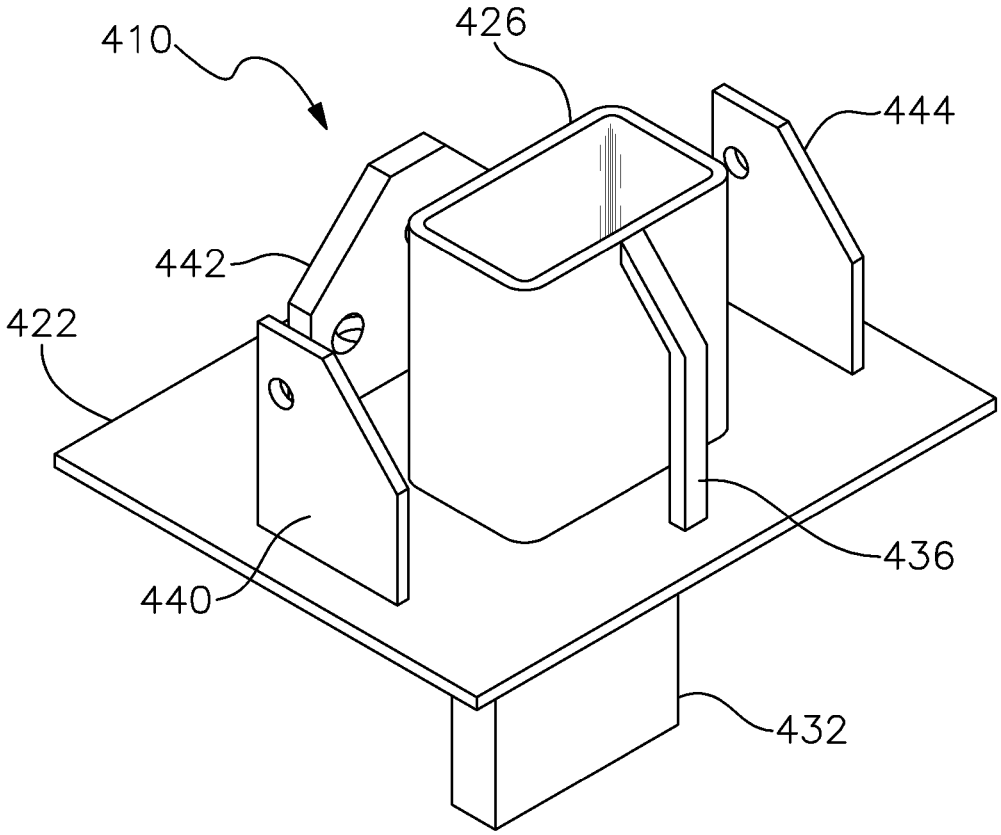
FIG. 17 is an upper perspective view of an alternative support and anchoring system in accordance with this invention featuring a rectangularly shaped deck penetrating anchor.

FIG. 17 shows an alternative support and anchoring system 410, which again features a flat base plate 422 that supports an upwardly facing stanchion receptacle 426. Plate like toe rail brackets 440, 442 and 444 are arranged about the receptacle in a manner as previously described. Likewise, upper anchor handle 436 is interconnected between one side of the receptacle and an upper surface of base plate 422. The most significantly different feature of this version is the penetrating anchor 432, which features a generally rectilinear shape rather than the tubular or cylindrical shape previously described. It should be understood that the shape of the penetrating anchor may be varied within the scope of this invention. In all cases, it should be inserted through a hole or opening in the underlying deck which extends from the upper to the lower surface of the deck. The penetrating anchor should also be constrained within that hole so that lateral movement of the penetrating anchor across the deck is restricted. Such constraint may be provided by shaping the deck hole conformably to the cross sectional shape of the penetrating anchor and/or through the use of anchoring bolts or screws that are engaged through the base plate and into the deck.

FIGS. 18 and 19 depict rectilinear and cylindrical plugs for forming the holes through the concrete deck for receiving the deck penetrating anchor. Each of the plugs includes an interior cavity. In particular, plug 16 includes an open end 604 providing access to an interior cavity 606. The front and back walls 608 and 610 of plug 600 include respective, aligned lifting holes 612 which are employed as described below. A floor 614 of plug 600 is provided with fastener mounting holes 616 that are utilized also as described below.

Plug 602, FIG. 19 features a cylindrical outer wall 630 having a pair of aligned lifting holes 632. A floor 634 is formed at the bottom of the cylinder and a central fastener accommodating hole 638 is formed in floor 634. The upper end 638 of the plug opens into an interior cavity 640.

The plugs are utilized to form the openings through the concrete deck for accommodating the penetrating anchors in the manner described above. In particular, the selected plug 600, 602 is installed as the concrete deck is poured such that the concrete surrounds the side walls of the plug. Typically, the floor of the plug is engaged with a plywood or other wooden bottom of the form in which the deck is poured. Fastening screws are installed through holes 616, 636 to secure the plug in place on the base of the form. Before the concrete is cured, a handle is inserted through aligned holes 612, 632. Concrete is then poured around the outer walls of the plug. The plug is manufactured so that it is taller than the thickness of the deck being poured.

After the deck cures sufficiently, the plug is disengaged from the underlying form. A worker reaches into the cavity 606, 640 and uses an extended screw driver shaft to remove the fastener from the floor 614, 634 of the respective plug. The worker then grasps the lifting rod and pulls the plug upwardly to remove it from the deck. This leaves behind an opening in the shape of the plug 600,602. The penetrating anchor of the support and anchoring device can then be engaged with the pre-formed opening so that the device can be used in the manner described herein.

It should be understood that the plug may have a wide variety of shapes, depths and sizes. By the same token, the penetrating anchor may be configured in various ways so that it extends through the opening that is formed fully through the deck from the upper to the lower surface thereof. The penetrating anchor should be exposed from the lower surface of the deck to provide access to anchor points therein.

The support and anchoring device of this invention may be composed of a wide variety of materials that are strong and durable. Steel is preferred, although various metal alloys and high strength plastics may alternatively be used. The system may be manufactured by various techniques including but not limited to welding, molding, stamping, etc. The stanchion accommodating receptacle may have various cross sectional configurations for accepting stanchions that are rectangular, circular, curved angular or have various other shapes. More particularly, the receptacle should be adapted to meet any custom or specific engineering specifications that a client may require, as well as any OSHA or other governmentally mandated specifications.

Anchoring points may be provided as described herein and otherwise to accept either horizontal or vertical safety lines. A unique benefit of the present invention is the provision of anchoring points for use both on and below the level of the deck on which the safety fence or guardrail is supported. The present invention provides a much stronger and more stable support for guard rails and safety fences used on multiple level building sites. The strength of the support and anchoring system is effectively the strength of the deck, slab or structure through which is it mounted rather than the strength of the fastening components used to secure the mounting system to the deck. Because guard rail strength is improved significantly, the risk of accidental falls and resulting worker injuries is greatly reduced.

An alternative two-piece version of the safety fence support and anchoring system is shown in FIGS. 20-26. In particular, this version employs a first piece 701, shown in FIGS. 20-23 and a second piece 702 shown in FIGS. 24 and 25, which are assembled as shown by system 710 in FIG. 26. Preferably, each of pieces 701 and 702 comprises a unitary piece of steel or other strong and durable material as previously described. These pieces may be formed by various manufacturing processes, although metal stamping is especially particularly preferred for purposes of mass production, which allows the pieces to be constructed in a relatively quick, convenient, and cost efficient manner. Alternatively, pieces 701 and 702 may be welded, molded or formed by other known manufacturing techniques. In the stamping process, the pieces 701 and 702 typically include a plurality of plates that are cut, stamped and folded using known types of manufacturing equipment and processes for such purposes.

As shown in FIGS. 20-23, piece 701 includes a base plate 722 that is unitarily connected to a stanchion receptacle 727 having a generally rectilinear configuration. Wall 727 of receptacle 726 is folded or otherwise extends upwardly from base plate 722. A pair of upwardly folded or otherwise formed extension segments 733 and 735 are similarly connected to the base plate on respective ends of receptacle wall 727. An upwardly turned section 729 connected to the outer edge of base plate 722 effectively defines a toe rail receptacle 741 between wall 727 and upwardly turned section 729. A slot or opening 743 is formed through base plate 722 for receiving anchor component 702 in a manner that will be described more fully below. As best shown in FIG. 22, fastening holes 747 may be formed in the base plate through both the toe rail receptacle area 741 and the floor section 749 of stanchion receptacle 726 for securing piece 701 to an underlying deck.

Figure 24:
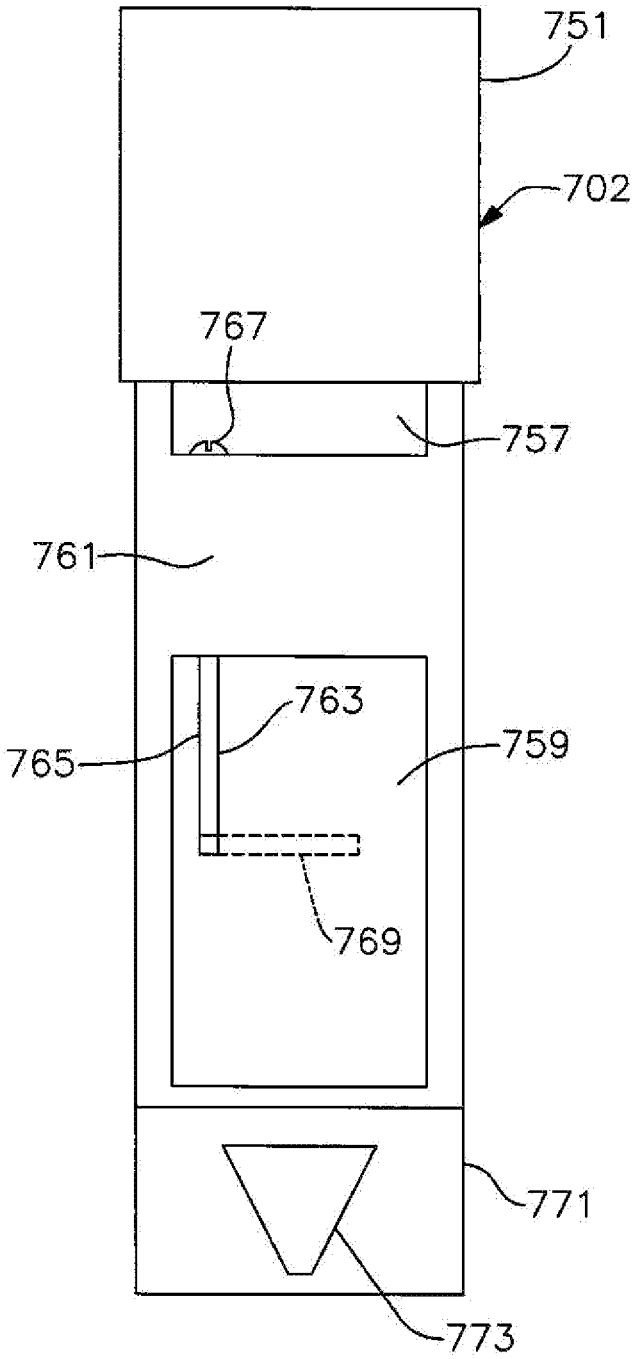
FIGS. 24 and 25 are front and side elevational views respectively of a second unitarily constructed piece comprising a deck penetrating anchor component that is utilized with the piece shown in FIGS. 20-23.
Figure 25:
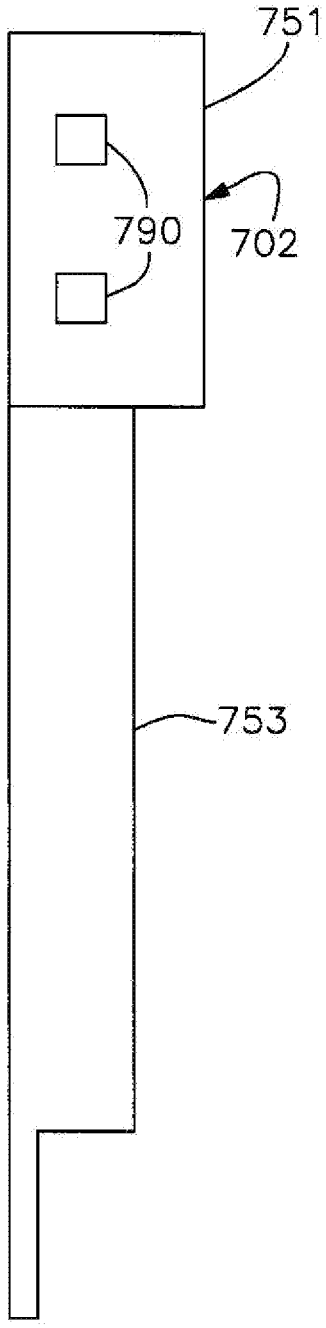

Second piece 702 of system 710, FIGS. 24 and 25, also includes a stamped or alternatively manufactured construction. More particularly, piece 702 includes an upper, generally rectilinear support portion 751, see also FIG. 26, and an elongate anchoring portion 753 that is unitarily attached to and depends from portion 751. Typically, support portion 751 has a central chamber 755. The chamber of support portion 751 may receive an optional second stanchion 718*x* designed to work in conjunction with stanchion 718. Anchoring portion 753 includes a narrow rectilinear cross sectional configuration extending vertically therethrough. Anchoring portion 753 includes an upper compartment 757 that communicates with chamber 755 and a lower compartment 759. A locking mechanism support section 761 is formed between compartments 757 and 759. This section supports a locking apparatus 763 that includes an axially rotatable bolt or pin 765 suspended from support 761 such as by a bolt head 767 positioned within compartment 757. A locking arm 769, shown in FIGS. 24 and 26 is attached proximate a lower end of pin 763. Pin 765 of locking apparatus 763 rotates within the support 761 and compartment 759 such that locking arm 769 is alternatable between a retracted position (shown in phantom) within the compartment 759 and a deployed condition as best shown in FIG. 26. This operation is described below.

Piece 702 further includes a lower end 771 through which a triangular anchor slot 773 is formed. The anchor slot is capable of receiving the clip of a safety strap or harness in the manner previously described.

Pieces 701 and 702 are integrated and assembled as a safety fence support and anchoring system 710 in the manner shown in FIG. 26. In particular, a transverse hole 770 is formed through the underlying deck 712. Piece 701 is then engaged with the upper surface of deck 712 such that the bottom of plate 722 generally flushly interengages the upper surface of deck 712. Piece 701 is positioned so that slot 743 is aligned with the transverse hole 770 in the deck. The base plate and integrally attached stanchion receptacle 726 are then secured to the deck by tapcon screws or other types of fasteners, which are inserted through holes 747, FIG. 22, into the deck 712. A stanchion 718 (shown in phantom) may then be inserted into stanchion receptacle 726 in the previously described manner.

Piece 702 is then interengaged with piece 701. In particular, the elongate lower anchoring portion 753 of piece 702 is inserted through slot 743 in base plate 722 such that the lower anchoring portion extends through transverse hole 770 in deck 712. See FIG. 26. The lower anchoring portion 753 is long enough such that lower end 771 of piece 702 and at least a portion of lower compartment 759 are positioned and supported below the bottom surface 781 of deck 712. More particularly, the arm 769 of locking device 763 must be free to pivot out of and into compartment 759 beneath lower surface 781 of deck 712. At the same time, arm 769 should be in close or snug contact with bottom surface 781 so that when the locking device is pivoted to extend the arm outwardly from compartment 759, the arm effectively cinches against the bottom surface 781 of deck 712. By operating the locking device and opening the arm 769 such that it engages the bottom 781 of the deck, the inserted piece 702 and anchoring portion 753 are securely and effectively locked in place in the deck 712. In order to remove piece 702, a worker must access the deployed arm 769 from underneath deck 712 and pivot the arm into a closed condition (shown in phantom) within compartment 759 of anchoring portion 753. Piece 702 can then be removed from the transverse hole 770 in deck 712 and from the piece 701 by inserting an appropriate tool into lifting holes 790 in opposing walls of support portion 751 and lifting the piece 702 from piece 701. The embodiment of FIGS. 20-26 allows the anchoring component to be quickly and securely engaged with an underlying deck and also allows the anchoring component to be quickly and conveniently removed from the underlying deck as required.

From the foregoing it may be seen that the apparatus of this invention provides for a safety fence support and anchoring system for use on multi-level buildings. While this detailed description has set forth particularly preferred embodiments of the apparatus of this invention, numerous modifications and variations of the structure of this invention, all within the scope of the invention, will readily occur to those skilled in the art. Accordingly, it is understood that this description is illustrative only of the principles of the invention and is not limitative thereof.

Although specific features of the invention are shown in some of the drawings and not others, this is for convenience only, as each feature may be combined with any and all of the other features in accordance with this invention.

Other embodiments will occur to those skilled in the art and are within the following claims:

What is claimed is:

1. A multi-level deck safety fence support and anchoring system, said system comprising:

an elevated concrete deck supported above an underlying deck, which elevated concrete deck has opposing top and bottom surfaces;

a generally flat base plate having substantially planar opposing upper and lower faces, said lower face being generally flushly interengaged with and releasably secured to said top surface of said elevated concrete deck;

a stanchion receptacle fixedly and non-pivotally attached to and extending upwardly from said upper face of said base plate and having a central receptacle opening with a closed bottom formed by said upper face of said base plate for receiving and supporting a lower end of an upper stanchion such that said upper stanchion extends upwardly from said elevated concrete deck and longitudinal movement of said upper stanchion downwardly through said central receptacle opening and said elevated concrete deck is restricted; and a tubular deck penetrating anchor component non-pivotally connected to and suspended below said lower face of said base plate, said tubular deck penetrating component being received by and configured to be conformably and removably received by and constrained within a transverse opening pre-formed through said elevated concrete deck, which transverse opening extends fully through said elevated concrete deck from said top surface to said bottom surface thereof such that said system has a fracture strength that is dependent upon the strength of said upper concrete deck; said tubular deck penetrating anchor component being exposed through said bottom surface of said elevated concrete deck and having a lower safety line anchor fastened thereto, said lower safety fine anchor being engaged by and attached to an upper portion of a safety line, which safety line hangs downwardly from said lower safety line anchor such that a lower portion of said safety line is attachable to a worker on said underlying deck for supporting the worker on said underlying deck.

2. The system of claim 1 further including a lower support plate that is fastened interiorly to said tubular deck penetrating anchor component below said base plate and which extends downwardly from said tubular deck penetrating anchor component for fastening an upper end of the underlying stanchion thereto.

3. The system of claim 2, wherein said safety line anchor comprises a lower safety line anchoring handle fastened to and carried by said tubular deck penetrating anchor component and said support plate below said base plate for attaching one end of said safety line thereto.

4. The system of claim 1 in which aid lower safety line anchor that is fastened within and extends across an interior opening of said tubular deck penetrating anchor component.

5. The system of claim 4 in which said lower safety line anchor includes a rod that is fastened at respective ends to said tubular deck penetrating anchor component proximate a distal end thereof and which extends across said interior opening of said anchor component.

6. The system of claim 5 further including a harness secured to said lower portion of said safety line for attaching to a worker on said underlying deck.

7. A multi-level deck safety fence support and anchoring system, said system comprising:

an elevated concrete deck supported above an underlying deck, which elevated concrete deck has opposing top and bottom surfaces;

a generally flat base plate having substantially planar opposing upper and lower faces, said lower face being generally flushly interengaged with and releasably secured to said top surface of said elevated concrete deck;

a stanchion receptacle fixedly and non-pivotally attached to and extending upwardly from said upper face of said base plate and having a central receptacle opening with a closed bottom formed by said upper face of said base plate for receiving and supporting a lower end of an upper stanchion such that said upper stanchion extends upwardly from said elevated concrete deck and downward longitudinal movement of said upper stanchion through said central receptacle opening and said elevated concrete deck is restricted; and a tubular deck penetrating anchor component connected to and suspended below said lower face of said base plate, said deck penetrating component being received by and configured to be conformably and removably received by and constrained within a transverse opening pre-formed through said elevated concrete deck, which transverse opening extends fully through said elevated concrete deck from said top surface to said bottom surface thereof such that said system has a fracture strength that is dependent upon the strength of said upper concrete deck; said deck anchoring component being exposed through said bottom surface of said elevated concrete deck and securing an upper end portion of an underlying stanchion mounted to and extending upwardly from said underlying deck, which upper end portion of said underlying stanchion is fastened to said deck penetrating anchor component such that said underlying stanchion is longitudinally spaced apart from said upper stanchion and longitudinally immovable relative to an interior opening of said tubular deck penetrating anchor component and said underlying stanchion is restricted from being movably adjusted longitudinally upwardly through said elevated concrete deck.

8. The system of claim 7 further including a support plate fastened to said deck penetrating anchor component and depending therefrom, said upper end portion of said underlying stanchion being fastened to said support plate to secure said underlying stanchion to said deck penetrating anchor component.

9. The system of claim 8 further including a lower safety line anchor fastened to at least one of said deck penetrating anchor component and said support plate for attaching one end of said safety line thereto, an opposite end of said safety line for attaching to and supporting a worker on said lower deck.

* * * * *